US006309290B1

(12) United States Patent
Wang et al.

(10) Patent No.: US 6,309,290 B1
(45) Date of Patent: Oct. 30, 2001

(54) CHEMICAL MECHANICAL POLISHING HEAD HAVING FLOATING WAFER RETAINING RING AND WAFER CARRIER WITH MULTI-ZONE POLISHING PRESSURE CONTROL

(75) Inventors: Huey-Ming Wang, Fremont; Gerard S. Moloney, Milpitas; Scott Chin, Palo Alto; John J. Geraghty, Burlingame; William Dyson, Jr., San Jose; Tanlin K. Dickey, Sunnyvale, all of CA (US)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/294,547

(22) Filed: Apr. 19, 1999

Related U.S. Application Data

(63) Continuation-in-part of application No. 09/261,112, filed on Mar. 3, 1999, now Pat. No. 6,231,428.

(51) Int. Cl.[7] ..... B24B 5/02

(52) U.S. Cl. ..... 451/398; 451/288; 451/289; 451/290

(58) Field of Search ..... 451/40, 63, 286, 451/287, 288, 289, 290, 397, 398

(56) References Cited

U.S. PATENT DOCUMENTS

| | | |
|---|---|---|
| 3,579,916 | 5/1971 | Boettcher . |
| 3,631,634 | 1/1972 | Weber . |
| 3,841,028 | 10/1974 | Katzke . |

(List continued on next page.)

FOREIGN PATENT DOCUMENTS

| | | |
|---|---|---|
| 88904709.8 | 2/1988 | (EP) . |
| 0747167A2 | 12/1996 | (EP) . |
| 2079532A | 1/1982 | (GB) . |

(List continued on next page.)

OTHER PUBLICATIONS

"Precision one side finish work method" (Abstracts of Japan, vol. 7 No. 271, Dec. 3, 1983).

*Primary Examiner*—Timothy V. Eley
(74) *Attorney, Agent, or Firm*—Flehr Hohbach Test Albritton & Herbert LLP

(57) ABSTRACT

The invention provides structure and method for achieving a uniformly polished or planarized substrate such as a semiconductor wafer including achieving substantially uniform polishing between the center of the semiconductor wafer and the edge of the wafer. In one aspect the invention provides a polishing apparatus including a housing, a carrier for mounting a substrate to be polished, a retaining ring circumscribing the carrier for retaining the substrate, a first coupling attaching the retaining ring to the carrier such that the retaining ring may move relative to the carrier, a second coupling attaching the carrier to the housing such that the carrier may move relative to the housing, the housing and the first coupling defining a first pressure chamber to exert a pressure force against the retaining ring, and the housing and the second coupling defining a second pressure chamber to exert a pressure force against the subcarrier. In one embodiment, the couplings are diaphragms. In another embodiment, the invention includes a single-or multiple-chambered wafer carrier or subcarrier capable of modifying a differential polishing pressure across the surface of the wafer or other substrate. The chambered-subcarrier permits customization of polishing pressure across the surface of the wafer to achieve greater material removal uniformity. The invention also provides a retaining ring having a special edge profile that assists in smoothing an pre-compressing the polishing pad to increase polishing uniformity. A method for polishing and a semiconductor manufacture is also provided by embodiments of the invention.

28 Claims, 24 Drawing Sheets

U.S. PATENT DOCUMENTS

| | | | | |
|---|---|---|---|---|
| 4,081,928 | | 4/1978 | Kinnebrew . | |
| 4,270,316 | | 6/1981 | Kramer et al. . | |
| 4,519,168 | | 5/1985 | Cesna . | |
| 4,680,893 | | 7/1987 | Cronkhite et al. . | |
| 4,918,870 | | 4/1990 | Torbert et al. . | |
| 4,954,142 | | 9/1990 | Carr et al. . | |
| 5,205,082 | | 4/1993 | Shendon et al. . | |
| 5,443,416 | | 8/1995 | Volodarsky et al. . | |
| 5,527,209 | | 6/1996 | Volodarsky et al. | 451/388 |
| 5,582,534 | | 12/1996 | Shendon et al. | 451/41 |
| 5,584,751 | | 12/1996 | Kobayashi et al. | 451/288 |
| 5,624,299 | | 4/1997 | Shendon | 451/28 |
| 5,643,053 | | 7/1997 | Shendon | 451/28 |
| 5,679,065 | * | 10/1997 | Henderson | 451/290 |
| 5,681,215 | | 10/1997 | Sherwood et al. | 451/388 |
| 5,738,574 | | 4/1998 | Tolles et al. | 451/288 |
| 5,775,983 | | 7/1998 | Shendon et al. | 451/444 |
| 5,803,799 | * | 9/1998 | Volodarsky et al. | 451/288 |
| 5,820,448 | * | 10/1998 | Shamouillian et al. | 451/287 |
| 5,941,758 | * | 8/1999 | Mack | 451/41 |
| 6,019,670 | * | 2/2000 | Cheng et al. | 451/56 |
| 6,024,630 | * | 2/2000 | Shendon et al. | 451/41 |
| 6,033,292 | * | 3/2000 | Inaba | 451/288 |
| 6,077,151 | * | 6/2000 | Black et al. | 451/53 |
| 6,093,089 | * | 7/2000 | Chen et al. | 451/288 |
| 6,093,091 | * | 7/2000 | Keller | 451/388 |
| 6,110,025 | * | 8/2000 | Williams et al. | 451/286 |
| 6,113,480 | * | 9/2000 | Hu et al. | 451/289 |
| 6,116,992 | * | 9/2000 | Prince | 451/286 |

FOREIGN PATENT DOCUMENTS

| | | |
|---|---|---|
| 205818A | 4/1991 | (GB) . |
| 50-133596 | 10/1975 | (JP) . |
| 54-62268 | 5/1979 | (JP) . |
| 56-146667 | 11/1981 | (JP) . |
| 59-19671 | 2/1984 | (JP) . |
| 60-129522 | 8/1985 | (JP) . |
| 61-193781 | 8/1986 | (JP) . |
| 62-162460 | 7/1987 | (JP) . |
| 1-92064 | 4/1989 | (JP) . |
| 1-216768 | 8/1989 | (JP) . |

* cited by examiner

CHEMICAL MECHANICAL POLISHING HEAD HAVING FLOATING WAFER RETAINING RING AND WAFER CARRIER WITH MULTI-ZONE POLISHING PRESSURE CONTROL

RELATED APPLICATIONS

This application is a continuation-in-part application of U.S. Pat. Application Ser. No. 09/261,112 filed Mar. 3, 1999 now U.S. Pat. No. 231,428, which is hereby incorporated reference in its entirety.

FIELD OF THE INVENTION

The invention relates to chemical mechanical planarization and polishing of substrates including silicon surfaces, metal films, oxide films, and other types of films on a surface, more particularly to a polishing head including a substrate carrier assembly with substrate retaining ring, and most particularly to a multi-pressure chamber polishing head and method for silicon or glass substrate polishing and chemical mechanical planarization of various oxides, metals, or other deposited materials on the surface of such substrates wherein the substrate carrier and substrate retaining ring are separately controllable.

BACKGROUND

Sub-micron integrated circuits (ICs) require that the device surfaces be planarized at their metal inter-connect steps. Chemical mechanical polishing (CMP) is the technology of choice for planarizing semiconductor wafer surfaces. The IC transistor packing density has been doubled about every 18 months for some number of years and there has been consistent effort to maintain this trend.

There are at least two methods by which to increase the packing density of transistors on a chip. The first method is to increase the device or die size. This is not always the best method, however, because as the die size increases, the die yield per wafer may typically decrease. Since the defect density per unit area is the constraint factor, the amount of defect-free dies per area decreases as the die size increases. Not only will the yield be lower, but the number of dies that can be stepped (printed) on the wafer will also decrease. The second method is to shrink the size of the transistor feature. Smaller transistors mean a higher switching speed, which is an added benefit. By decreasing the transistor size, more transistors and more logic functions or memory bits can be packed into the same device area without increasing die size.

Sub-half micron technology has been rapidly evolved into sub-quarter micron technology in the past few years alone. The number of transistors being fabricated on each chip has increased enormously - from hundreds of thousands transistors per chip three years ago to several million transistors per chip today. This density is expected to increase even further in the near future. The current solution to the challenge is to build layers upon layers of inter-connect wiring with insulating (dielectric) thin films in between. The wiring is also connectable vertically through vias; to achieve all electrical paths as required by the integrated circuit functions.

Inlaid metal line structure, using inlaid metal lines embedded in insulating dielectric layers, allows for metal wiring connections to be made on the same plane as well as on an up and down direction through plasma etched trenches and vies in the dielectric layer. Theoretically, these connection planes can be built with as many layers on top of each other as desired, as long as each layer is well planarized with CMP process. The ultimate limit of the interconnect is formed by the connection resistance (R) and the proximity capacitance (C). The so-called RC constant limits the signal-to-noise ratio and causes the power consumption to increase, rendering the chip non-functional. According to industry projections, the number of transistors to be integrated on a chip will be as many as one billion, and the number of layers of interconnect will increase to up to nine layers or more.

To meet the predicted inter-connect requirements, the CMP process and CMP tool performance would advantageously be improved to achieve reduce the wafer edge exclusion due to over-and under-polishing from 6 mm to less than 3 mm so that the physical area from which large dies may be formed, and reduce polishing non-uniformity by providing a polishing head that is able to apply uniform and appropriate force across the entire surface of the wafer during polishing. Current variations in film uniformities after CMP, at the wafer edge (2–15 mm from the edge) result in lost die yield in the outer edges of the wafer. This edge non-uniformity is due to either over or under polishing near the wafer edge. By providing a CMP polishing head with the ability to adjust the amount of edge polishing to compensate for over or under polishing, significant yield improvements can be achieved.

Integrated circuits are conventionally formed on substrates, particularly silicon wafers, by the sequential deposition of one or more layers, which layers may be conductive, insulative, or semiconductive. These structures are sometimes referred to as the multi-layer metal structures (MIM's) and are important relative to achieving close-packing of circuit elements on the chip with the ever decreasing design rules.

Flat panel displays such as those used in notebook computers, personal data assistants (PDAs), cellular telephones, and other electronic devices, may typically deposit one or more layers on a glass or other transparent substrate to form the display elements such as active or passive LCD circuitry. After each layer is deposited, the layer is etched to remove material from selected regions to create circuitry features. As a series of layers are deposited and etched, the outer or topmost surface of the substrate becomes successively less planar because the distance between the outer surface and the underlying substrate is greatest in regions of the substrate where the least etching has occurred, and the distance between the outer surface and the underlying substrate is least in regions where the greatest etching has occurred. Even for a single layer, the non-planar surface takes on an uneven profile of peaks and valleys. With a plurality of patterned layers, the difference in the height between the peaks and valleys becomes much more severe, and may typically vary by several microns.

A non-planar upper surface is problematic respective of surface photolithography used to pattern the surface, and respective of layers that may fracture if deposited on a surface having excessive height variation. Therefore, there is a need to planarize the substrate surface periodically to provide a planar layer surface. Planarization removes the non-planar outer surface to form a relatively flat, smooth surface and involves polishing away the conductive, semiconductive, or insulative material. Following planarization, additional layers may be deposited on the exposed outer surface to form additional structures including interconnect lines between structures, or the upper layer may be etched to form vias to structures beneath the exposed surface. Polishing generally and chemical mechanical polishing (CMP) more particularly are known methods for surface planarization.

The polishing process is designed to achieve a particular surface finish (roughness or smoothness) and a flatness (freedom from large scale topography). Failure to provide minimum finish and flatness may result in defective substrates, which in turn may result in defective integrated circuits.

During CMP, a substrate such as a semiconductor wafer, is typically mounted with the surface to be polished exposed, on a wafer carrier which is part of or attached to a polishing head. The mounted substrate is then placed against a rotating polishing pad disposed on a base portion of the polishing machine. The polishing pad is typically oriented such that it's flat polishing surface is horizontal to provide for even distribution of polishing slurry and interaction with the substrate face in parallel opposition to the pad. Horizontal orientation of the pad surface (the pad surface normal is vertical) is also desirable as it permits the wafer to contact the pad at least partially under the influence of gravity, and at the very least interact in such manner that the gravitational force is not unevenly applied between the wafer and the polishing pad. In addition to the pad rotation, the carrier head may rotate to provide additional motion between the substrate and polishing pad surface. The polishing slurry, typically including an abrasive suspended in a liquid and for CMP at least one chemically-reactive agent, may be applied to the polishing pad to provide an abrasive polishing mixture, and for CMP an abrasive and chemically reactive mixture at the pad substrate interface. Various polishing pads, polishing slurries, and reactive mixtures are known in the art, and which in combination allow particular finish and flatness characteristics to be achieved. Relative speed between the polishing pad and the substrate, total polishing time, and the pressure applied during polishing, in addition to other factors influence the surface flatness and finish, as well as the uniformity. It is also desirable that the polishing of successive substrates, or where a multiple head polisher is used, all substrates polished during any particular polishing operation are polished to the same extent, including removal of substantially the same amount of material and providing the same flatness and finish. CMP and wafer polishing generally are well known in the art and not described in further detail here.

In U.S. Pat. No. 5,205,082 there is described a flexible diaphragm mounting of the sub-carrier having numerous advantages over earlier structures and methods, and U.S. Pat. No. 5,584,751 provides for some control of the down force on the retaining ring through the use of a flexible bladder; however, neither these patents describe structure for direct independent control of the pressure exerted at the interface of the wafer and retaining ring, or any sort of differential pressure to modify the edge polishing or planarization effects.

In view of the foregoing, there is a need for a chemical mechanical polishing apparatus which optimizes polishing throughput, flatness uniformity, and finish, while minimizing the risk of contamination or destruction of any substrate.

In view of the above, there remains a need for a polishing head that provides a substantially uniform pressure across the substrate surface being polished, that maintains the substrate substantially parallel to the polishing pad during the polishing operation, and that maintains the substrate within the carrier portion of the polishing head without inducing undesirable polishing anomalies at the periphery of the substrate.

SUMMARY

The invention provides structure and method for achieving a uniformly polished or planarized substrate such as a semiconductor wafer including achieving substantially uniform polishing between the center of the semiconductor wafer and the edge of the wafer. The inventive chemical mechanical polishing (CMP) head has a floating wafer retaining ring and wafer carrier (also referred to as wafer subcarrier) with multi-zone polishing pressure control. In one aspect the invention provides a polishing apparatus including a housing, a carrier for mounting a substrate to be polished, a retaining ring circumscribing the carrier for retaining the substrate, a first coupling attaching the retaining ring to the carrier such that the retaining ring may move relative to the carrier, a second coupling attaching the carrier to the housing such that the carrier may move relative to the housing, the housing and the first coupling defining a first pressure chamber to exert a pressure force against the retaining ring, and the housing and the second coupling defining a second pressure chamber to exert a pressure force against the subcarrier. In one embodiment, the couplings are diaphragms.

In another aspect, the invention provides structure and method for a substrate (semiconductor wafer) retaining ring for a polishing or planarization machine wherein the retaining ring includes a lower surface for contacting a polishing pad during polishing, an inner surface disposed adjacent to an outer surface of the carrier and the periphery of a substrate mounting surface of the carrier, the inner surface and the carrier mounting surface periphery forming a pocket for maintaining the substrate during polishing, and a pad conditioning member disposed at the lower outer radial portion of the retaining ring where the retaining ring contacts the pad during polishing and defining a shape profile transitioning between a first planar surface substantially parallel to a plane of the polishing pad and a second planar surface substantially perpendicular to the polishing pad. In one embodiment of the invention, the substrate retaining ring is characterized by presenting an angle between about 15 degrees and about 25 degrees out of parallel with respect to the nominal plane of said polishing pad. In a different embodiment, the substrate retaining ring is characterized by presenting an angle substantially 20 degrees out of parallel with respect to the nominal plane of said polishing pad.

In another aspect the invention further provides a chambered wafer carrier wherein the one or more chambers permit modification of the polishing pressure radially from the center of the wafer to the edge of the wafer so that the amount of material removed from the wafer may be adjusted as a function of the distance from the center to the edge. The one or more chambers are formed in the wafer carrier by forming grooves into the carrier surface and placing a flexible membrane against the subcarrier and between the subcarrier and the wafer to be polished to complete formation of a sealed pressure chamber. Application of pressurized fluid into the chambers causes the membrane to expand, press the membrane against the backside of the wafer, and urge the wafer against the polishing pad with greater force than other portions of the wafer. The chambered wafer carrier may be used in conjunction with the aforedescribed first pressure chamber exerting a pressure force against the retaining ring and the second pressure chamber exerting a pressure force against the carrier.

In one embodiment of the chambered carrier, a single groove disposed near the outer edge of the carrier is provided to modify the polishing force near the edge of the wafer to control non-uniformities between the edge and the rest of the wafer. In another embodiment, the chambered carrier is a multi-grooved multi-chambered carrier where each groove provides a pressure to modify the polishing pressure in a region adjacent to each groove.

The chambered carrier may be used with a variety of polishing machines, including, but not limited to a polishing apparatus or method having a floating retaining ring or floating wafer carrier.

In another aspect, the invention provides a method of planarizing a semiconductor wafer including: supporting a back-side surface of the wafer with a wafer support subcarrier, applying a polishing force against the support subcarrier to press a front surface of the wafer against a polishing pad, restraining movement of the wafer from the support subcarrier during polishing with a retaining ring circumferentially disposed around a portion of the subcarrier and the wafer, and applying a pad conditioning force against the retaining ring to press a front surface of the retaining ring against the polishing pad. In one embodiment of the inventive method, the pad conditioning force is applied independently of said polishing force, while in a different embodiment, the pad conditioning force is somewhat coupled to the polishing force. In another alternative embodiment, the pad conditioning force is applied to a first area of the pad in a direction orthogonal to a plane defined by the pad surface, to a second area of said pad in a direction having a first fractional component orthogonal to the plane and having a second fractional component parallel to the plane using a retaining ring having a chamfered edge profile. In yet another embodiment of the inventive method, the polishing force is controlled radially from the center of the wafer toward the edge of the wafer by applying differential polishing pressures to different radial zones of the wafer.

In another aspect, the invention provides a semiconductor wafer polished or planarized according to the inventive method.

DETAILED DESCRIPTION OF EMBODIMENTS OF THE INVENTION

Figure 1:
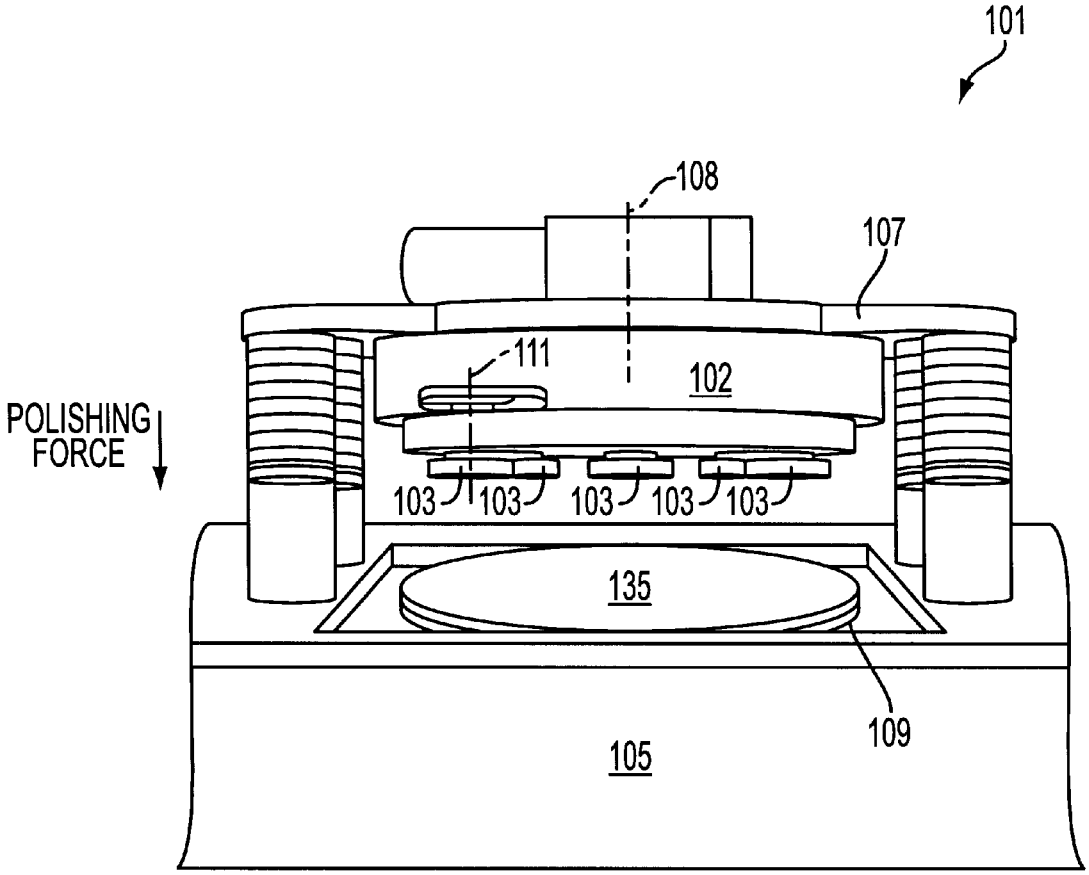
FIG. 1 is a diagrammatic illustration showing an embodiment of a multi-head polishing/planarization apparatus.
Figure 3:
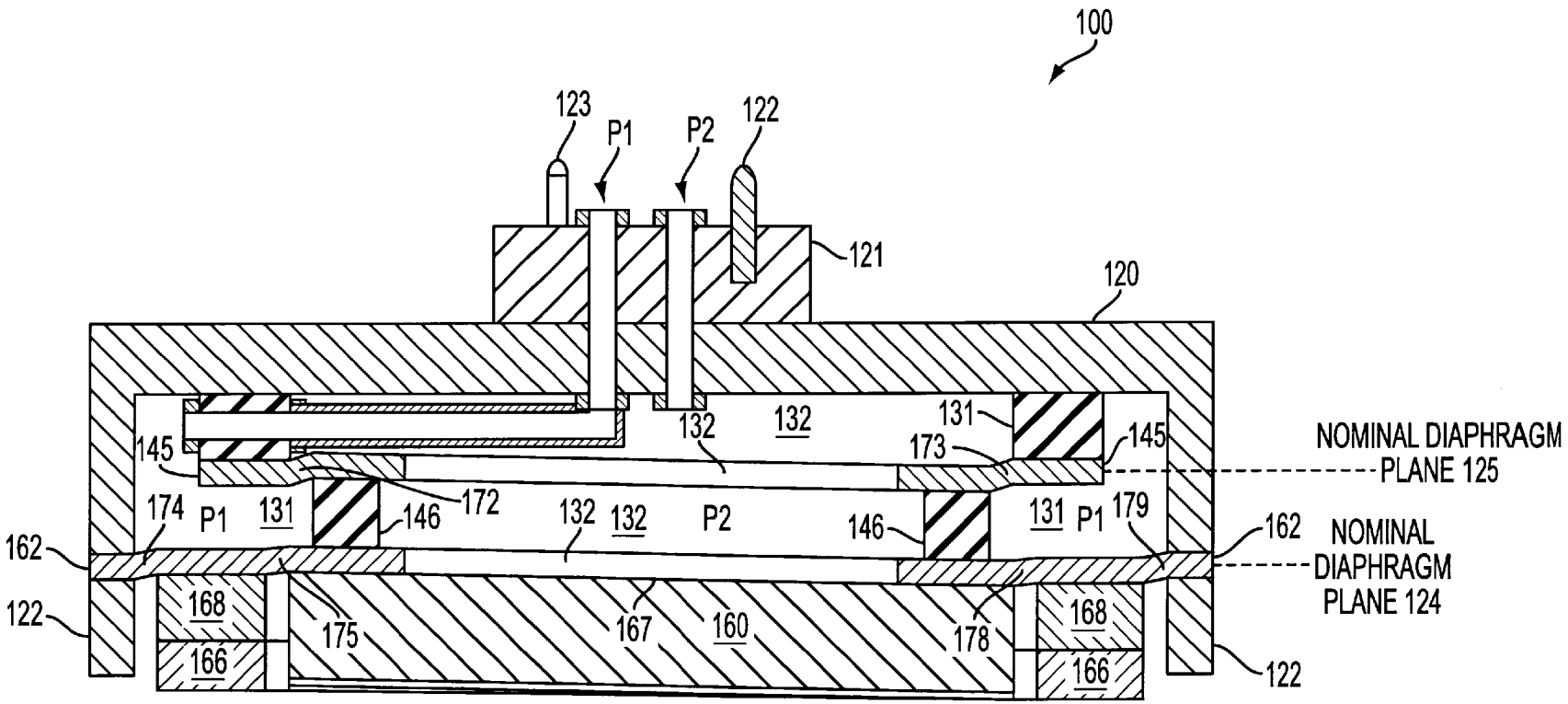
FIG. 3 is a diagrammatic illustration showing a simple embodiment of the inventive two-chambered polishing head in FIG. 3 further illustrating at exaggerated scale the manner in which linking elements (diaphragms) permit movement of the wafer subcarrier and wafer retaining ring.

In FIG. 1, there is shown a chemical mechanical polishing or planarization (CMP) tool 101, that includes a carousel 102 carrying a plurality of polishing head assemblies 103 comprised of a head mounting assembly 104 and the substrate (wafer) carrier assembly 106 (See FIG. 3). We use the term "polishing" here to mean either polishing of a substrate 113 generally including semiconductor wafer 113 substrates, and also to planarization when the substrate is a semiconductor wafer onto which electronic circuit elements have been deposited. Semiconductor wafers are typically thin and somewhat brittle disks having diameters nominally between 100 mm and 300 mm. Currently 200 mm semiconductor wafers are used extensively, but the use of 300 mm wafers is under development. The inventive design is applicable to semiconductor wafers and other substrates at least up to 300 mm diameter, and advantageously confines any significant wafer surface polishing nonuniformities to no more than about the so-called 2 mm exclusion zone at the radial periphery of the semiconductor disc, and frequently to an annular region less than about 2 mm from the edge of the wafer.

A base 105 provides support for the other components including a bridge 107 which supports and permits raising and lowering of the carousel with attached head assemblies. Each head mounting assembly 104 is installed on carousel 102, and each of the polishing head assemblies 103 are mounted to head mounting assembly 104 for rotation, the carousel is mounted for rotation about a central carousel axis 108 and each polishing head assembly 103 axis of rotation 111 is substantially parallel to, but separated from, the carousel axes of rotation 108. CMP tool 101 also includes the motor driven platen 109 mounted for rotation about a platen drive axes 110. Platen 109 holds a polishing pad 135 and is driven to rotate by a platen motor (not shown). This particular embodiment of a CMP tool is a multi-head design, meaning that there are a plurality of polishing heads for each carousel; however, single head CMP tools are known, and inventive head assembly 103, retainer ring 166, and method for polishing may be used with either a multi-head or single-head type polishing apparatus.

Furthermore, in this particular CMP design, each of the plurality of heads are driven by a single head motor which drives a chain (not shown), which in turn drives each of the polishing heads 103 via a chain and sprocket mechanism; however, the invention may be used in embodiments in which each head 103 is rotated with a separate motor. The inventive CMP tool also incorporates a rotary union 116 providing five different gas/fluid channels to communicate pressurized fluids such as air, water, vacuum, or the like between stationary sources external to the head and locations on or within the wafer carrier assembly 106. In embodiments of the invention in which the chambered subcarrier is incorporated, additional rotary union ports are included to provide the required pressurized fluids to the additional chambers.

In operation, the polishing platen 109 with adhered polishing pad 135 rotates, the carousel 102 rotates, and each of the heads 103 rotates about their own axis. In one embodiment of the inventive CMP tool, the carousel axis of rotation is off-set from the platen axis of rotation by about one inch. The speed at which each component rotates is selected such that each portion on the wafer travels substantially the same distance at the same average speed as every other point on a wafer so as to provide for uniform polishing or planarization of the substrate. As the polishing pad is typically somewhat compressible, the velocity and manner of the interaction between the pad and the wafer where the wafer first contacts the pad is a significant determinant of the amount of material removed from the edge of the wafer, and of the uniformity of the polished wafer surface.

A polishing tool having a plurality of carousel mounted head assemblies is described in U.S. Pat. No. 4,918,870 entitled Floating Subcarriers for Wafer Polishing Apparatus; a polishing tool having a floating head and floating retainer ring is described in U.S. Pat. No. 5,205,082 Wafer Polisher head Having Floating Retainer Ring; and a rotary union for use in a polisher head is described in U.S. Pat. No. 5,443,416 and entitled Rotary Union for Coupling Fluids in a Wafer Polishing Apparatus; each of which are hereby incorporated by reference.

In one embodiment, the inventive structure and method provide a two-chambered head having a disc shaped subcarrier having an upper surface 163 interior to the polishing apparatus and a lower surface 164 for mounting a substrate (i.e. semiconductor wafer) 113 and an annular shaped retaining ring 166 disposed coaxially with, and fitting around both, the lower portion of the subcarrier 160 and around the edge of the wafer substrate 113 to maintain the substrate directly underneath and in contact with the subcarrier 160 and a polishing pad surface 135 which itself is adhered to the platen 109. Maintaining the wafer directly underneath the subcarrier is important for uniformity as the subcarrier imposes a downward polishing force onto the back side of the wafer to force the front side of the wafer against the pad. One of the chambers (P2) 132 is in fluid communication with carrier 160 and exerts a downward polishing pressure (or force) during polishing on the subcarrier 160 and indirectly of the substrate 113 against the polishing pad 135 (referred to as "subcarrier force" or "wafer force"). The second chamber (P1) 131 is in fluid communication with the retaining ring 166 via a retaining ring adapter 168 and exerts a downward pressure during polishing of the retaining ring 166 against the polishing pad 135 (referred to as "ring force"). The two chambers 131,132 and their associated pressure/vacuum sources 114, 115 permit control of the pressure (or force) exerted by the wafer 113 and separately by the retaining ring 166 against the polishing pad surface 135.

While in one embodiment of the invention the subcarrier force and ring force are selected independently, the structure can be adapted to provide greater and lesser degrees of coupling between the ring force and subcarrier force. By making appropriate choices as the properties of a linkage between a head housing supporting structure 120 and the subcarrier 160, and between the subcarrier 160 and the ring 166, degrees of independence in the range from independent movement of the subcarrier and ring to strong coupling between the subcarrier and ring can be achieved. In one embodiment of the invention, the material and geometrical characteristics of linking elements formed in the manner of diaphragms 145, 162 provide optimal linking to achieve uniform polishing (or planarization) over the surface of a semiconductor wafer, even at the edges of the substrate.

Additional embodiments of the invention having a chambered subcarrier are also described. These chambered subcarriers add additional pressure chambers that permit even greater control of the polishing force as a function of position.

In another embodiment, the size and shape of the retaining ring 166 is modified compared to conventional retaining ring structures in order to pre-compress and/or condition the polishing pad 135 in a region near the outer peripheral edge of the substrate 113 so that deleterious affects associated with the movement of substrate 113 across pad 135 from one area of the pad to another are not manifested as non-linearities on the polished substrate surface. The inventive retaining ring 166 acts to flatten out the pad 135 at the leading and training edges of motion so that before the advancing substrate contacts a new area of the pad, the pad is essentially flat and coplanar with the substrate surface; and, as contact between the substrate and the pad is about to end, the pad is kept flat and coplanar with the polished surface of the substrate. In this way, the substrate always experiences a flat, precompressed, and substantially uniform polishing pad surface.

The retaining ring pre-compresses the polishing pad before it travels across the wafer surface. This results in the whole wafer surface seeing a polishing pad with the same amount of pre-compression which results in a move uniform removal of material across the wafer surface. With independent control of the retaining ring pressure it is possible to modulate the amount of polishing pad pre-compression, thus influencing the amount of material removed from the wafer edge. Computer control, with or without feedback, such as using end point detection means, can assist in achieving the desired uniformity.

Figure 2:
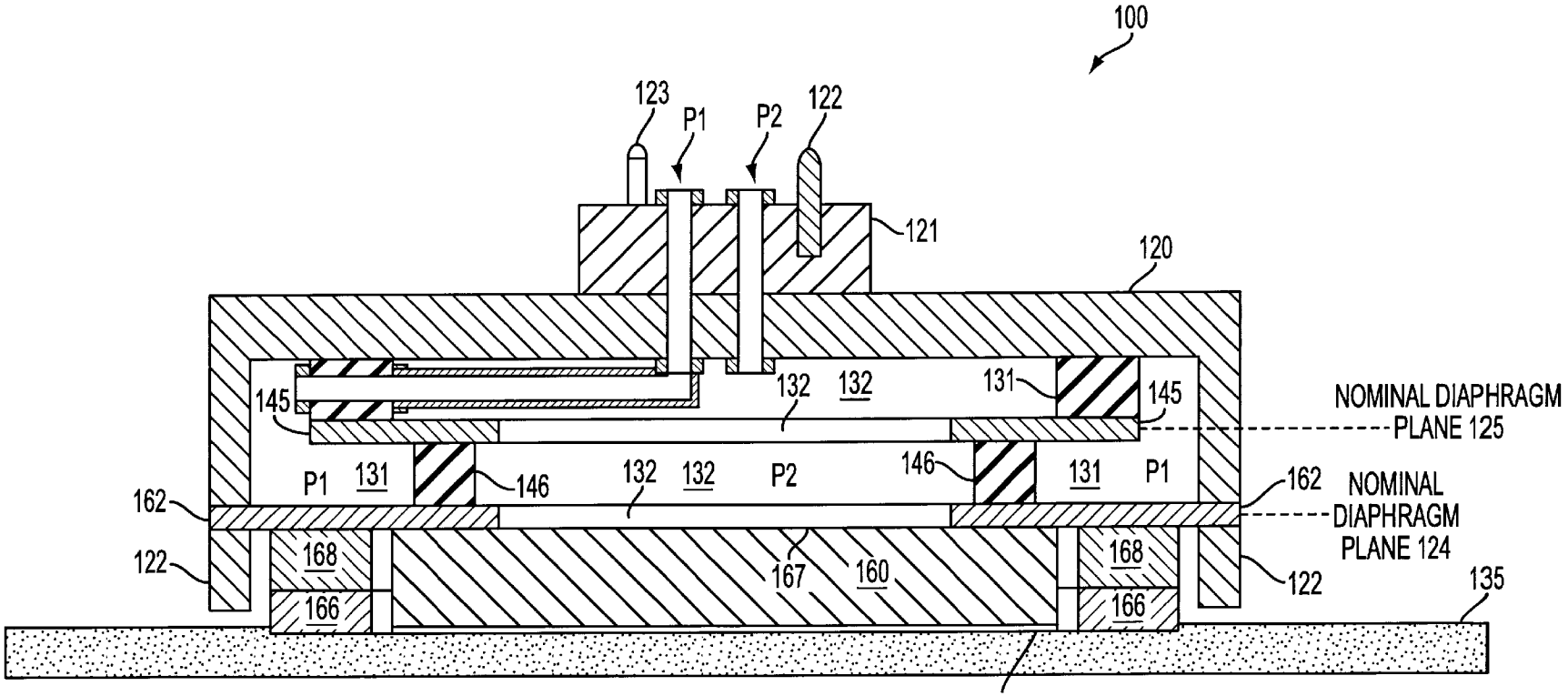
FIG. 2 is a diagrammatic illustration showing a simple embodiment of the inventive two-chambered polishing head.

We first turn our attention to a simple first embodiment of the inventive two-chambered polishing head 100 shown in FIG. 2 to illustrate the manner in which selected aspects of the invention operate. In particular we show and describe the manner in which pressure to the retaining ring assembly (including retaining ring adapter 168 and retaining ring 166) and the carrier 160 are effectuated and controlled. We will then describe other aspects of the invention relative to somewhat more elaborate alternative embodiments that include additional optional, but advantageous features.

Turret mounting adapter 121 and pins 122, 123 or other attachment means facilitate alignment and attachment or mounting of housing 120 to a spindle 119 mounted for rotation relative to carousel 102, or in single head embodiments, to other supporting structure, such as an arm that moves the head across the surface of the pad while the head and pad are rotating. Housing 120 provides a supporting structure for other head components. Secondary diaphragm 145 is mounted to housing 120 by spacer ring 131 to separate secondary diaphragm from housing 120 to allow a range of vertical and angular motion of the diaphragm and structures attached thereto (including carrier 160) relative to a nominal secondary diaphragm plane 125. (The primary and secondary diaphragms also permit some small horizontal movement as a result of the angular tilt alone or in conjunction with vertical translation that is provided to accommodate angular variations at the interface between the carrier-pad and retaining ring-pad interfaces, but this horizontal movement is typically small compared to the vertical movement.)

Spacer ring 131 may be formed integrally with housing 120 in this embodiment and provide the same function; however, as will be described in an alternative embodiment (See for example, FIG. 5) spacer ring 131 is advantageously formed from a separate piece and attached to the housing with fasteners (such as screws) and concentric O-ring gaskets to assure the attachment is air- and pressure-tight.

Carrier 160 and retaining ring assembly 165 (including retaining ring adapter 168 and retaining ring 166) are similarly attached to primary diaphragm 162 which itself is attached to a lower portion of housing 162. Carrier 160 and retaining ring 166 are thus able to translate vertically and tilt to accommodate irregularities in the surface of the pad and to assist in flattening the polishing pad where the pad first encounters retaining ring 166 proximate the edge of the wafer 113. Generically, this type of diaphragm facilitated movement has been referred to as "floating," the carrier and retaining ring as "floating carrier" and "floating retaining ring", and a head incorporating these elements has been referred to as a "floating head" design. While the inventive head utilizes "floating" elements, the structure and method of operation are different than that known in the art heretofore.

Flange ring 146 connects secondary diaphragm 145 to an upper surface 163 of subcarrier 160 which itself is attached to primary diaphragm 162. Flange ring 146 and subcarrier 160 are effectively clamped together and move as a unit, but retaining ring assembly 167 is mounted only to the primary diaphragm and is free to move subject only to constraints on movement imposed by the primary and secondary diaphragms. Flange ring 146 links primary diaphragm 162 and secondary diaphragm 145. Frictional forces between the diaphragm and the flange ring and subcarrier assist in holding the diaphragm in place and in maintaining a tension across the diaphragm. The manner in which primary and secondary diaphragms permit translational and angular movement of the carrier and retaining ring is further shown by the diagrammatic illustration in FIG. 3, which shows a greatly exaggerated condition in which the nominal planar conformation of each diaphragm 145, 162 is altered to permit the translational and angular degrees of freedom. This exaggerated degree of diaphragm flexation illustrated in the figure, especially in angular orientation, would not be expected to be encountered during polishing, and the vertical translation would typically be experienced only during wafer loading and unloading operations. In particular, secondary diaphragm 145 experiences some flexing or distortion in first and second flexation regions 172, 173 in the span between attachment to seal ring 131 and flange ring 146; and primary diaphragm experiences different flexing or distortion at third, fourth, fifth, and sixth flexation regions 174, 175, 178, 179 where it spans its attachments to housing 120 and carrier 160.

In this description, the terms "upper" and "lower" conveniently refer to relative orientations of structures when the structure being described is used in its normal operating state, typically as shown in the drawings. In the same manner, the terms "vertical" and "horizontal" also refer to orientations or movements when the invention or an embodiment or element of an embodiment is used in its intended orientation. This is appropriate for a polishing machine, as wafer polishing machines of the type known by the inventors provide for a horizontal polishing pad surface which fixes the orientations of other polisher components.

Figure 4:
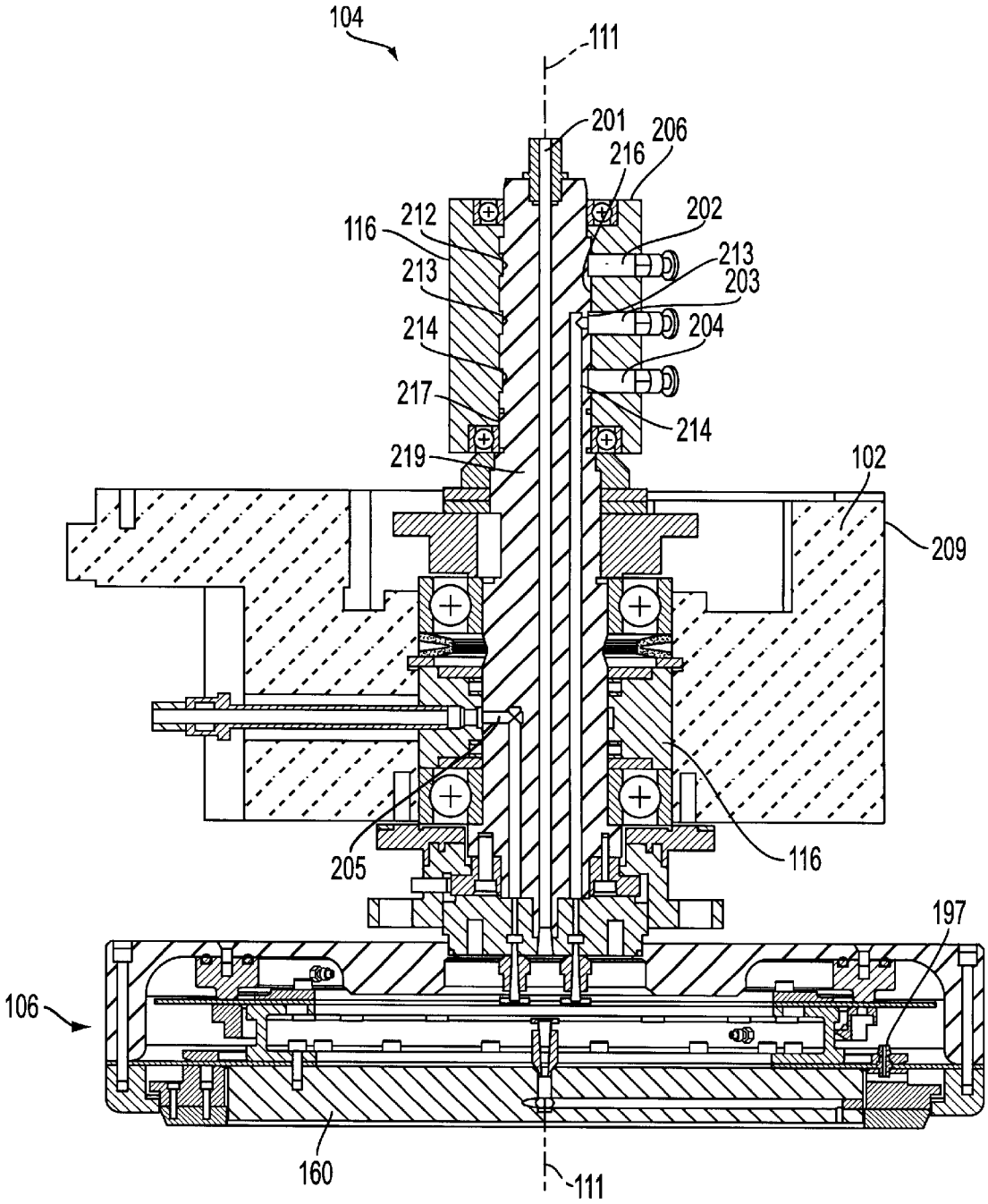
FIG. 4 is a diagrammatic illustration showing a sectional assembly drawing of embodiments of portions of the carousel, head mounting assembly, rotary unions, and wafer carrier assembly.

We next turn our attention to the alternative and somewhat more sophisticated embodiment of the inventive polishing head assembly 103 illustrated in FIG. 4. Particular emphasis is directed toward wafer carrier assembly 106; however, the rotary union 116 and head mounting assembly 104 components of the polishing head assembly 103 are also described. We note that although some structures in the first embodiment of the invention (See FIG. 2) have somewhat different structures from those illustrated for this alternative embodiment (See FIG. 4) identical reference numbers have been retained so that the similar functions provided by the elements in the several embodiments is made clear.

Polishing head assembly 103 generally includes a spindle 119 defining a spindle axis of rotation 111, a rotary union 116, and spindle support means 209 including bearings that provide means for attaching spindle 119 into a spindle support which is attached to the bridge 107 in a manner that permits rotation of the spindle. These spindle support structures are known in the mechanical arts and not described here in any detail. Structure within the spindle is illustrated and described as that structure pertains to the structure and operation of rotary union 116.

Rotary union 116 provides means for coupling pressurized and non-pressurized fluids (gases, liquids, vacuum, and the like) between a fluid source, such as vacuum source, which is stationary and non-rotating and the rotatable polishing head wafer carrier assembly 106. The rotary union is adapted to mount to the non-rotatable portion of the polishing head and provides means for confining and continually coupling a pressurized or non-pressurized fluid between a non-rotatable fluid source and a region of space adjacent to an exterior surface of the rotatable spindle shaft 119. While a rotary union is specifically illustrated in the embodiment of FIG. 4, it will be understood that rotary unions are applicable to the other embodiments of the invention.

One or more fluid sources are coupled to rotary union 116 via tubing and control valve (not shown). Rotary union 116 has a recessed area on an interior surface portion which defines a typically cylindrical reservoir 212, 213, 214 between interior surface portion 216 of rotary union 116 and the exterior surface 217 of spindle shaft 119. Seals 218 are provided between the rotatable shaft 119 and the nonrotatable portion of the rotary union to prevent leakage between the reservoirs and regions exterior to the reservoirs. Conventional seals as are known in the mechanical arts may be used. A bore or port 201 is also provided down the center of the spindle shaft to communicate a fluid via a rotatable coupling.

Spindle shaft 119 has multiple passageways, in one embodiment five passageways, extending from the exterior shaft surface and the top of the shaft to a hollow bores within the spindle shaft. Due to the particular sectional view in FIG. 4, only three of the five passageways are visible in the drawing. From each bore the vacuum or other pressurized or non-pressurized fluids are communicated via couplings and or tubing within the wafer carrier assembly 106 to the location at which the fluid is required. The precise location or existence of the couplings are an implementation detail and not important to the inventive concept except as described hereinafter. These recited structures provide means for confining and continually coupling one or more pressurized fluids between the region adjacent to the exterior surface of the rotatable shaft and the enclosed chamber, but other means may be used. A rotary union that provides fewer channels than that in this particular embodiment of the invention is described in U.S. Pat. No. 5,443,416 and entitled Rotary Union for Coupling Fluids in a Wafer Polishing Apparatus, incorporated herein by reference.

Figure 5:
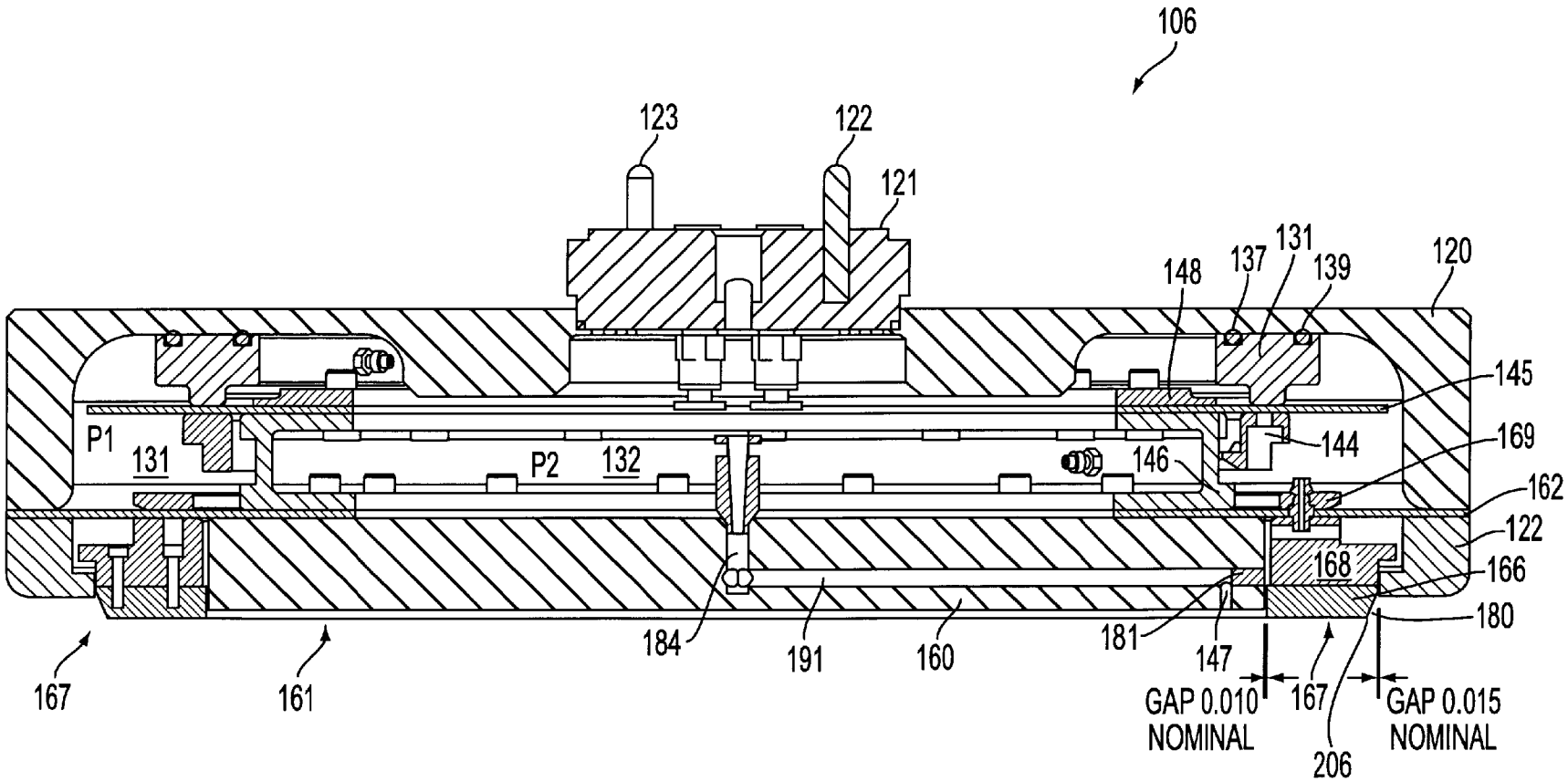
FIG. 5 is a diagrammatic illustration showing a more detailed sectional view of an embodiment of the inventive wafer carrier assembly.
Figure 6:
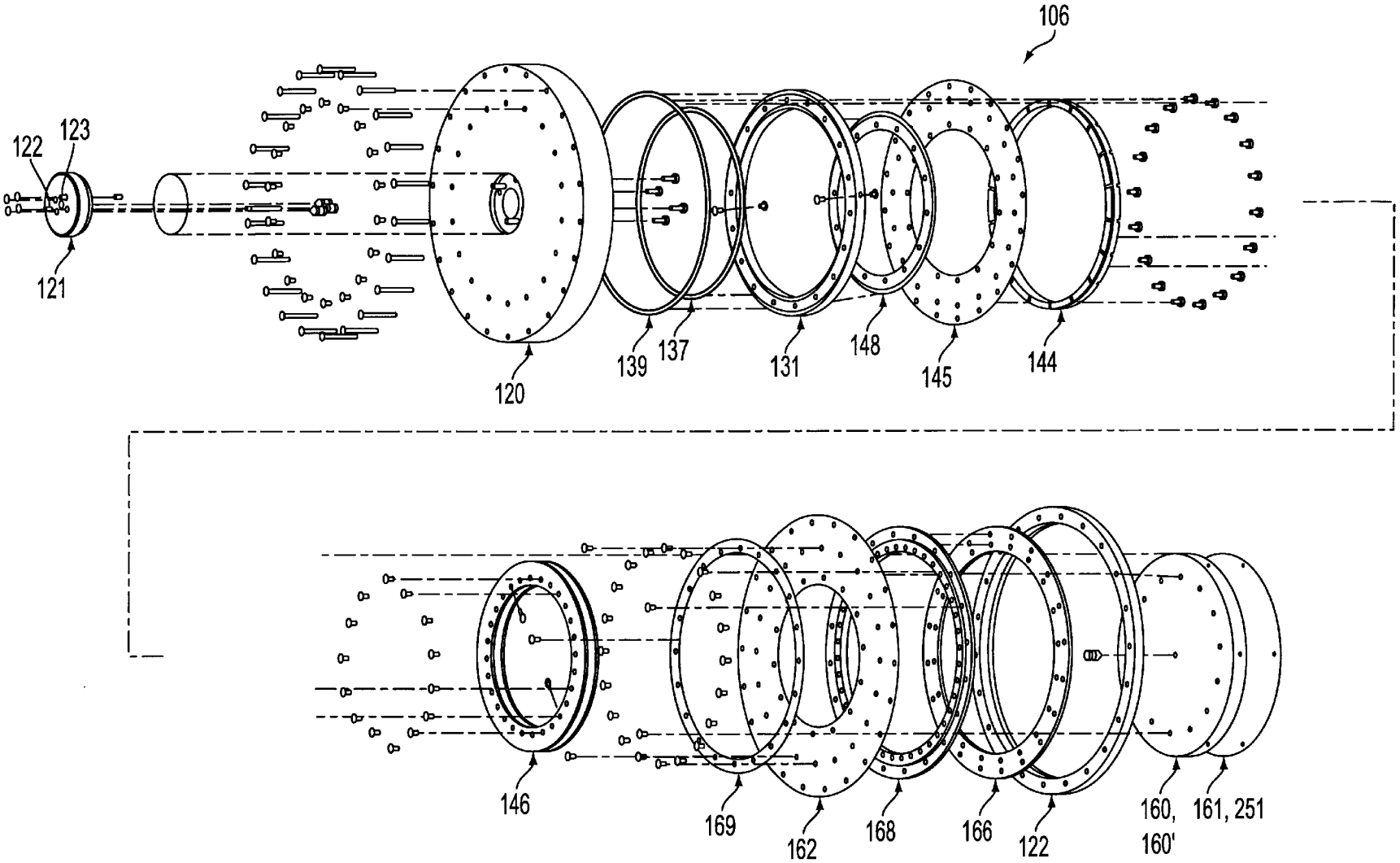
FIG. 6 is a diagrammatic illustration showing an exploded assembly drawing illustrating elements of the embodiment of the wafer carrier assembly shown in FIG. 5.

We now describe wafer carrier assembly 106 with respect to FIG. 5 showing a sectional view through "Section A—A" of wafer carrier assembly 106, and FIG. 6 showing an exploded assembly diagram of wafer carrier assembly 106. It is clear from FIG. 6 that wafer carrier assembly 106 has a high degree of symmetry about a central axis; however, it will be observed that not all elements are symmetrical with respect to the locations of holes, orifices, fitting, notches, and the like detailed features. Rather than describing wafer carrier assembly 106 with respect to any single diagram, we refer to the combination of FIG. 5 (side-view through Section A—A), FIG. 6 (exploded assembly drawing), FIG. 7 (enlarged sectional view of right-hand side of FIG. 5), and FIG. 8 (enlarged sectional view of left-hand side of FIG. 5) which show the constituent elements from somewhat different perspectives and make clearer the structure and operation of each element.

Chemical mechanical polishing as well as the characteristics of polishing pads, slurry, and wafer composition, are well known and not described with any degree of specificity except as is necessary to understand the invention.

Functionally, wafer carrier assembly 106 provides all of the structure needed to mount and hold a substrate 130 such as a semiconductor wafer during the polishing operation. (Note that this invention is applicable to polishing substrates other than semiconductor wafers.) Carrier assembly 106 provides vacuum at one lower surface 164 of a wafer subcarrier through holes or apertures 147 for holding the wafer during a period time between loading the wafer and initiation polishing. It also provides a downward polishing pressure on the wafer through the wafer subcarrier and a separate downward pressure on a retaining ring for maintaining the wafer within a pocket and for interacting with the polishing pad to reduce or eliminate polishing nonuniformity near the edge over the wafer. Wafer carrier assembly 106 also provides sources of fluids such as the deionized water (DI water), pressurized air, and vacuum at several chambers, orifices, and surfaces is described in greater detail hereinafter. The wafer carrier assembly is particularly important in that it provides a diaphragm mounted subcarrier and retaining ring assembly which itself includes a retaining ring adapter and a retaining ring. The diaphragm mounted components and their structural and functional relationships with other elements and chambers provide several of the advantageous features of the invention.

The upper housing 120 is mounted to mounting adapter 121 via four socket head screws, which in turn is mounted to the lower portion of head mounting assembly 104 via screws and positioned by first and second pins 122,123. Upper housing 120 provides a stable member to which other elements of the wafer carrier assembly may be mounted as described herein. Housing seal ring 129 is a generally circular element which acts to separate the first pressure chamber (P1) 131 from a second pressure chamber (P2) 132. The pair of O-rings 137, 139 are disposed within separate channels machined into an upper surface of housing seal ring 131 which when attached to an interior surface of upper housing 120 provides a leak-proof fluid and pressure seal between housing seal ring 131 and upper housing 120. The pressure in first pressure chamber 131 is operative to influence the downward acting pressure on retaining ring assembly 134 and its interaction with polishing pad 135. Pressure in second pressure chamber 132 is operative to influence the downward acting pressure on subcarrier 136 which in turn provides the polishing pressure exerted between the lower surface of wafer 138 and polishing pad 135. Optionally, a polymeric or other insert 161 may be used between lower surface 164 of subcarrier 106 in the upper, or backside, surface of wafer 138. Internal structure within wafer carrier assembly 106 provides both a degree of independence between the pressure and/or movement of retaining ring assembly 134 and subcarrier 136.

We note that one or more fittings 141 are provided to communicate pressurized air from a location or source 114 external to first pressure chamber 131 into the chamber, and one or more fittings 142 are provided to communicate pressurized air from a second external source or location 115 to second pressure chamber 132 in like manner. These fittings 141,142 are connected via appropriate tubing to channels within head mounting assembly 104 and rotary union 116, and appropriate control circuitry to provide the desired pressure levels. The manner and sequence in which pressures, vacuum, and/or fluids are communicated are described hereinafter.

The locking ring 144 is mounted to the lower surface of housing seal ring 131 via eighteen screws and attaches secondary diaphragm 145 between housing seal ring 131 and locking ring 144 by virtue of sandwiching or clamping secondary diaphragm between the two structures. Both housing seal ring 131 and locking ring 144 as well as the portion of secondary diaphragm 145 clamped between housing seal ring 131 and locking ring 144 are maintained in fixed position relative to upper housing 120. The portion of secondary diaphragm 145 lying radially interior to an inner radius of housing seal ring 131 is clamped on a lower surface by an upper surface of inner flanged ring 146 and on an upper surface by a lower surface of inner stop ring 148. The inner flanged ring and inner stop ring are attached by fastening means such as socket head cap screws 149.

Although housing seal ring 131, locking ring 144, and the portion of secondary diaphragm 145 clamped between these two structures maintain a fixed location relative to the surface of upper housing 120, both inner flanged ring 146 and inner stop ring 148 being suspended from secondary diaphragm 145 are at least somewhat free to move upward and downward relative to polishing pad 135 and upper housing 120, and to some degree, to change angular orientation or tilt relative to polishing pad 135 and upper housing 120. The ability of this structure to move vertically upward in downward and to tilt to alter its angular orientation permits structures attached to it such as subcarrier 136, wafer 138, and retaining ring assembly 134 to float on the surface of polishing pad 134.

The nature of the material from which secondary diaphragm 145 is fabricated, as well as secondary diaphragm thickness (Td), the distance between the clamped portion of secondary diaphragm 145 between the housing seal ring and the locking ring with respect to the clamped portion of secondary diaphragm 145 between inner flanged ring 146 and inner stop ring 148, as well as the physical gap were separation between first vertical edges 151 of inner flanged ring 146 and second vertical surfaces 152 of locking ring 144 adjacent to the first vertical edges 151 influence the amount of vertical movement and the amount of tilt or angular motion. These properties provide an effective spring constant of the diaphragm. Although the primary and secondary diaphragms in embodiments of the invention described here are formed from the same material, in general, different materials may be used.

In one embodiment of invention adapted to mounting 200 millimeter (mm) semiconductor wafers, the diaphragm is made from 0.05 inch thick BUNA N with Nylon material made by INTERTEX. This material has internal fibers that provide strength and stiffness while also providing the desired degree of elasticity. Those workers having ordinary skill in the art will appreciate in light of description provided here, that different dimensions and materials may be used to accomplish the same were similar operation. For example, a thin metallic sheet or membrane may be used for secondary diaphragm 145 so long as the thin metallic membrane provides sufficient elasticity so that it can be deflected vertically to respond to pressured applied to it and sufficient angular movement so that it can maintain contact with the pad during a polishing operation. In some instances, a flat sheet of material may not in and of itself possess sufficient elasticity; however, by forming the sheet in an appropriate manner such as with corrugated annular grooves, bellows, or the like, a metal linking element may provide alternative structures for the diaphragms described here. Composite materials may also be used to provide the desired properties. The relationship between the clamped and un-clamped portion of secondary diaphragm 145 and the separation between locking 144 and inner flanged ring 146 are shown in greater detail in FIGS. 7 and 8.

Inner stop ring 148, in addition to clamping inner flanged ring 146 to secondary diaphragm 145 provides a movement limit stop function to prevent excessive upward movement of inner stop ring 148, diaphragm 145, inner flanged ring 146, and structures attached thereto, from moving excessively upward into recess 152 within upper housing 120. In one embodiment of the invention, inner stop ring 148 and attached structures are able to move about 0.125 inches upward from a nominal position in which diaphragm 145 is planar before a stop contact surface 153 of inner stop ring 148 contacts an opposing contact surface 154 of housing seal ring 131, and about 0.10 inches downward from the nominal position, for a total travel distance of about 0.25 inches. Only a portion of this upward and downward (vertical) range of motion is needed during actual polishing; the remainder being used to extend the carrier beyond the bottom edge of the retaining ring during wafer (substrate) loading and unloading operations. The ability to project the edge of the subcarrier 160 beyond the lower edge of the retaining ring is advantageous and facilitates the loading and unloading operations.

The vertical range of motion is limited by mechanical stops rather than by the diaphragm material. The use of stops prevents unnecessary forces on the diaphragm when the carrier/wafer is not in contact with the pad, such as during loading and unloading operations, and during maintenance, or when powered-off that could in the long-term stretch or distort the diaphragm. The inventive structure also provides a carrier head assembly having an automatically self-adjusting wafer mounting pocket depth.

Subcarrier 160 is mounted to a lower surface 156 of inner flanged ring 146 by attachment means such as socket head cap screws 157 thereby effectively hanging subcarrier 160 from secondary diaphragm 145 (supported by mechanical stops on the stop rings when at the lower limit of its vertical range of motion, and prevented from moving excessively upward by a second set of mechanical stops) and providing the subcarrier with be vertical and angular motion already described. Primary diaphragm 162 is clamped between a circumferential ring of inner flanged ring 146 and attached to upper surface 163 of subcarrier 160 by socket head cap screws 157 near the edge of the subcarrier. Subcarrier 160 being formed other a nonporous ceramic material in at least one embodiment, is fitted with stainless-steel inserts to receive the threaded portions of screws 157.

We now describe aspects of retaining ring assembly 134 before describing important aspects of the interaction among retaining ring 134, subcarrier 136, and primary diaphragm 162. Retaining ring assembly 167 includes a retaining ring 166 and a retaining ring adapter 168. In one embodiment, retaining ring 166 is formed from Techtron™ PPS (Polyphenylene Sulfide). Retaining ring adapter 168 mounts to a lower surface 170 of outer stop ring 171 with primary diaphragm 162 clamped their between. Retaining ring 166 is formed of TECHTRON material and is attached to retaining ring adapter 168 via socket head screws through the primary diaphragm and outer stop ring. A chamfered portion 180 of retainer ring 166 at its outer radius advantageously reduces edge polishing non-linear areas which are typically encountered using conventional polishing tools. Outer stop ring 169 is co-axially mounted with respect to inner flanged ring 146 but at a larger radial distance from the center of the wafer carrier assembly 106, but is neither mounted to inner flanged ring 146 nor to any other elements except retaining ring adapter 168 and primary diaphragm 162, except that both outer stop ring 169 a and retaining ring assembly 134 are coupled together by primary diaphragm 162. The nature of this coupling is important to providing mechanical properties that contribute to the polishing benefits provided by this invention. Structures contributing to this coupling are illustrated in a larger scale and greater detail in FIGS. 7 and 8.

We now describe the structure and overall operation of primary diaphragm 162 and a manner in which it is attached to subcarrier 160 and retaining ring assembly 134. We also describe details of the wafer carrier assembly that contribute to its ability to reduce non-linear areas, often referred to as "ringing", at the edges of the polished wafer. First, it should be understood that primary diaphragm 162 should have stiffness with elasticity so that the coupling between pressure applied to subcarrier 160 and the separate pressure applied to retaining ring 166, and the movement of the subcarrier and retaining ring as a result of these pressures and the counter-acting upward force of polishing pad 135 falls within the appropriate range. By this we mean essentially that the movement of the retaining ring and of the subcarrier should be independent within some range of motion, but at the same time in some embodiments providing some coupling between the motions all of the retaining ring and the subcarrier.

The desired degree of coupling is affected by several factors, including: (i) controlling the span of primary diaphragm 162 between third clamped region 182 (between subcarrier 160 and inner flanged ring 146) and fourth clamped region 183 (between retaining ring adapter 168 and outer stop ring 169); (ii) controlling the thickness and material properties of primary diaphragm 162; (iii) controlling the geometry of the surfaces that interact with the diaphragm 162 in the span region; (iv) controlling the distance between opposing vertical surfaces 185 of subcarrier 160, vertical surface 186 of retaining ring adapter 168, and vertical surface 187 of retaining ring 166; and (v) controlling the distance or clearance between surface 188 of retaining ring adapter 168 and a vertical surface of 190 of lower housing 122, and between a vertical surface 189 of retaining ring 166 and that same vertical surface 190 of lower housing 122. By controlling these factors both vertical motion and angular motion are allowed to occur, but without excessive movement that might cause binding of the retaining ring either against subcarrier 160 or lower housing 122.

Figure 7:
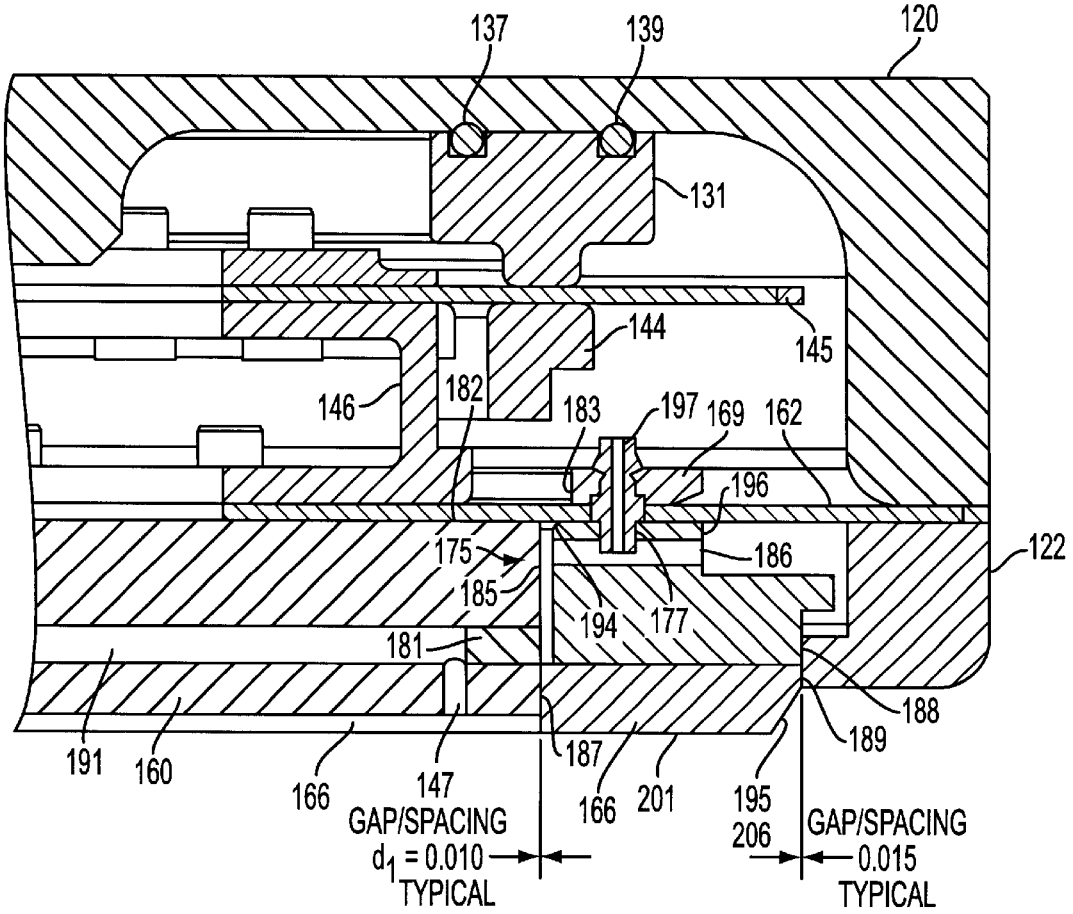
FIG. 7 is a diagrammatic illustration showing a detailed sectional view of a portion of the embodiment of the wafer carrier assembly of FIG. 5.

In one embodiment of the invention, the distance d1 between the subcarrier and the retaining ring adapter is 0.050 inches, the distance d2 between the subcarrier and the retaining ring is 0.010 inches, the distance d3 between the retaining ring adapter and a lower housing is about 0.5 inches, and the distance d4 between the retaining ring and lower housing is 0.015 inches. These relationships are illustrated in FIG. 7. Of course those workers having ordinary scale in the art will appreciate that these dimensions are exemplary and that other dimensions and relationships may be provided to accomplish the same functionality. In particular, one might expect that each of these dimensions might be modified by up to about 30 percent or more and still provide comparable operation, even if not optimal operation. Greater variations of dimensional tolerances would likely provide an operational but suboptimal apparatus.

Figure 8:
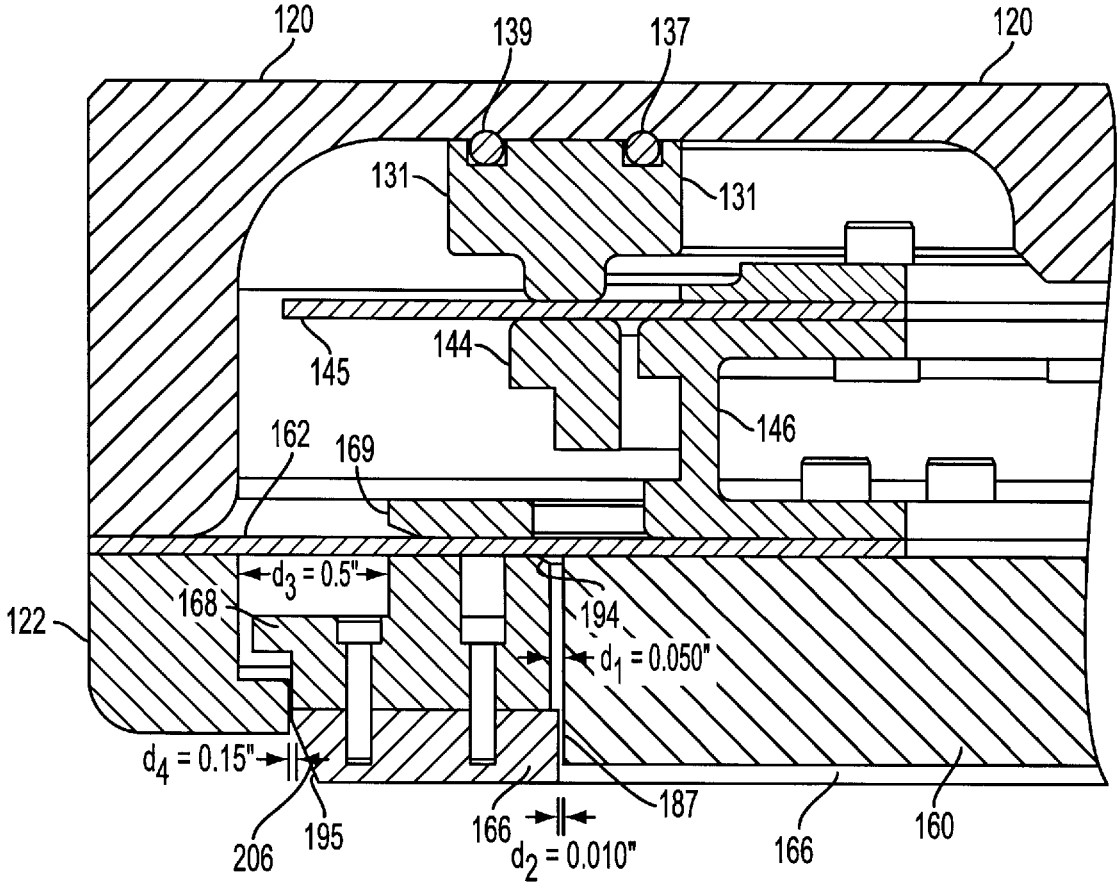
FIG. 8 is a diagrammatic illustration showing a detailed sectional view of a different portion of the embodiment of the wafer carrier assembly of FIG. 5.

We also note in the embodiment illustrated in FIGS. 7 and 8, that outer radial portion of subcarrier 160 adjacent to spanning portion of primary diaphragm 162 forms a substantially right angle with vertical surface 185; however, the opposing vertical surface of the retaining ring adapter has a beveled portion at the opposing comer 194. Maintaining a comer having about a square (90 degree) comer has been found to be beneficial for preventing subcarrier binding with the retaining ring or the retaining ring adapter. Furthermore, providing a slight bevel or chamfer 194 on the adjacent surface of retaining ring adapter 168 has been found to beneficial for retaining ring mobility without binding, but it has been observed that if the bevel is too great, then some undesired binding may occur. While this combination has been found to have certain advantages, those workers having ordinary skill the art will appreciate that other variations which facilitate smooth motion control without binding of the adjacent components.

Figure 12:
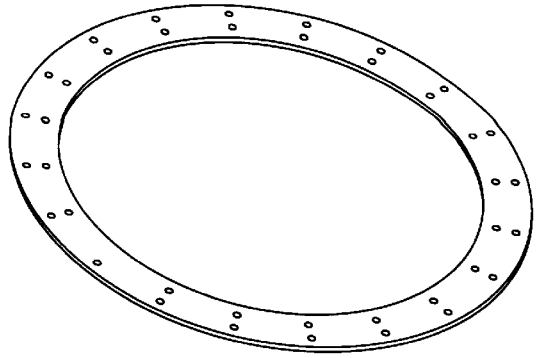
FIG. 12 is a diagrammatic illustration showing a perspective view of the embodiment of the inventive retaining ring in FIG. 9.
Figure 13:
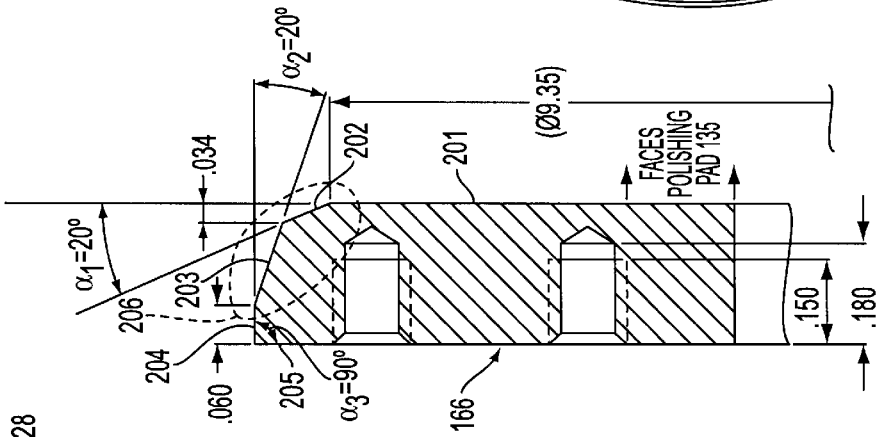
FIG. 13 is a diagrammatic illustration showing a sectional view through a portion of the retaining ring in FIG. 9, particularly showing the chamfered transition region at the outer radial periphery of the ring.
Figure 9:
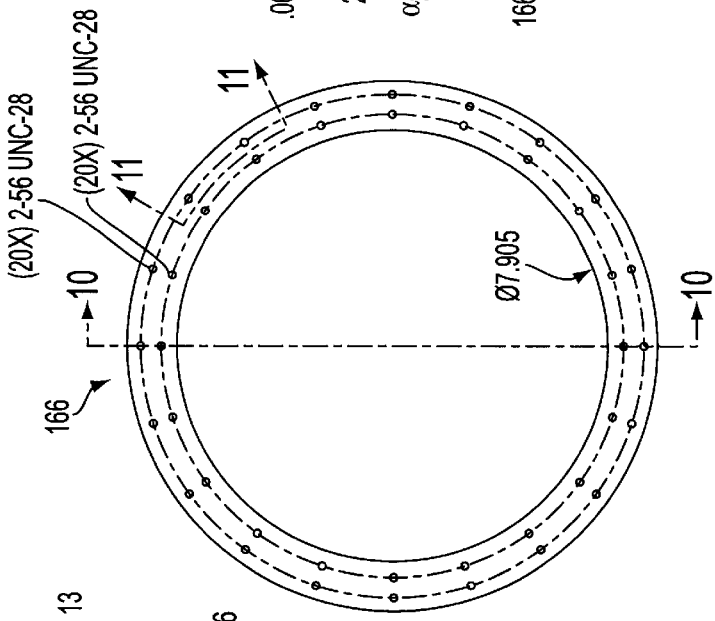
FIG. 9 is a diagrammatic illustration showing a plan view of an embodiment of the inventive retaining ring.
Figure 11:
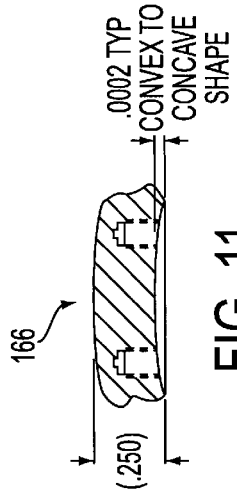
FIG. 11 is a diagrammatic illustration showing a detail of the embodiment of the inventive retaining ring in FIG. 9.
Figure 10:
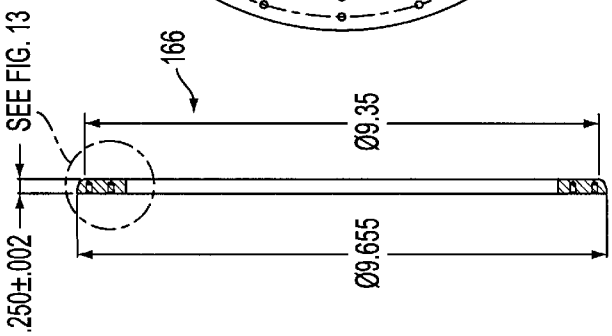
FIG. 10 is a diagrammatic illustration showing a sectional view of the embodiment of the inventive retaining ring in FIG. 9.

Further advantages of the invention have been realized by providing a particular shape profile at the outer or radial surface 195 of retaining ring 166 in what will be referred to as a transition region 206. Conventionally, retaining rings if provided at all, have been formed with a substantially vertical outer wall surface either because it provided a favorable surface profile to slide against a mating surface such as the equivalent of inner radial wall surface of lower housing 122, or because no thought was given to the importance of the profile of the edge and a default vertical profile was used. In one embodiment of the invention, the retaining ring 166 has shape profile illustrated in FIGS. 9–13 which show various aspects of the retaining ring at different levels of detail. FIG. 10 is a shows a sectional view of the embodiment of the retaining ring in FIG. 9, while FIG. 11 shows an detail, and FIG. 12 provides a perspective view of the retaining ring. FIG. 13 is a diagrammatic illustration showing a sectional view through a portion of the retaining ring particularly showing the chamfered transition region at the outer radial periphery of the ring.

For this embodiment of the retaining ring, a lower surface 201 which during polishing contacts polishing pad 135, transitions through two beveled surfaces 202, 203 to a substantially vertical surface 204 which in operation opposes a substantially parallel vertical surface 189 on lower housing 122, though a clearance gap is provided so as to eliminate binding. Surface 204 is substantially orthogonal to upper retaining rig surface 205, and upper surface 205 is substantially parallel to lower surface 201. Desirably, during manufacture of the wafer carrier assembly, an assembly fixture is used to maintain alignment of the constituent parts, and shims are used to set the clearance gap and other spacings between the ring 166 and the subcarrier 160 and housing 120, 122.

It has been determined empirically, that providing that this transition region 206 substantially improves the qualities of the edges of the polished wafer by eliminating nonlinearities in the polishing. These nonlinearities typically appear as troughs and peaks (waves or rings) within about three to five millimeters or more from the outer edge of the wafer. Without benefit of theory, the nature of this transition region 206 is thought to be important because the retaining ring in addition to holding the wafer in a pocket against the subcarrier during polishing operation also acts to press or flatten the polishing pad just prior to that portion of the pad contacting the wafer when the retaining ring is at the leading edge of motion and to expand of the region over which the pad is flat when that portion all of the retaining ring is a trailing edge portion of the wafer. A fact, the retaining ring maintains surface coplanarity with and around the wafer so that any conditions that cause the polishing pad 135 to buckle or distort, the accumulation of polishing slurry at the leading edge, or other non-linear or non-coplanar effects, occur outside of or under the retaining ring and not under or adjacent to the edge of the wafer.

It has also been determined that the particular retaining ring geometry in the transition region 206, that is the optimal angles for the transition region of $\alpha 1=20$ degrees, $\alpha 2=20$ degrees, and $\alpha 3=90$ degrees, is optimal for a multi-head polishing apparatus and for a particular combination of polishing pad 135, a polishing pad rotational speed of about 30 revolutions per minute (RPM), a wafer carrier assembly rotational speed of about 26 RPM, 200 mm diameter silicon wafers, a polishing pressure of for example, about five pounds per square inch (5 psi), and a TECHTRON material retaining ring. In this multi-head carousel based polisher, the effective linear speed of the ring across the surface of the pad is about 80–200 feet/min. Polishing pressures may be varied over a greater range to achieve the desired polishing effect. For example, the pressure on the subcarrier is typically in the range between about 1.5 psi and about 10 psi and the pressure on the retaining ring is typically in the range between about 1.5 psi and about 9.0 psi, though the pressure on the retaining ring can be the same as the pressure on the subcarrier. While the invention is not limited to any particular polishing pad types, one polishing pad useful for chemical mechanical polishing or planarization with the inventive head is the Rodel® CR IC1400-A4 (Rodel Part No. P05695, Product Type IC1400, K-GRV, PSA). This particular pad 135 has a nominal 35.75 inch diameter, thickness range between about 2.5 mm and about 2.8 mm, deflection of between about 0.02 mm and about 0.18 mm, compressibility of between about 0.7 and about 6.6 percent, and rebound of about 46 percent (all measured with the RM-10-27-95 test method). Another alternative is the Rodel CR IC1000-A4, P/V/SUBA type pads (Rodel Part No. P06342).

Retaining ring has a thickness of about 0.25 inches and the 20 degree bevel portion 202 at the lower surface of the ring extends upward about 0.034 inches and the vertical portion 204 extends about 0.060 inches before meeting the second beveled segment 203. These exemplary dimensions are illustrated in the drawing. For this particular combination of variables, it has been determined empirically that these angles are somewhat sensitive to about plus or minus two degrees for optimal performance; however, it is expected that somewhat greater range, for example from at least about plus or minus four degrees about the angles given provides useful results. However; it is noted that while the principal of providing a transition region for the retaining ring is a significant determining factor in achieving uniform polishing particularly at the edges of the wafer, the actual shape of this transition region may require tuning to particular physical parameters associated with the polishing operation. For example, use of different polishing pad's (particularly if they are of a different thickness, compensability, resiliency, or friction coefficient), different platen rotational speed, different carousel rotational speed, different wafer carrier assembly rotational speed, and even different polishing slurry may suggest an alternative transition region geometry for optimal results. Fortunately, once a CMP polishing tool is set up, these parameters normally do not change, or can be adjusted in accordance with standard quality control procedures performed during CMP tool setup.

For single head polishers (including for example, polishers of the type wherein the polishing pad rotates, the head rotates, and the head is driven to oscillate back and forth on a linear reciprocating motion) the same parameters are expected to pertain but the effective linear speed of the leading edge of the retaining ring across the pad will be a pertinent parameter rather than the combination of polishing pad speed, carousel speed, and head speed.

In one embodiment of the invention pertaining to the inventive retaining ring structure, the 20 degree transition angle on retaining ring provides substantial advantages over conventional square cornered retaining ring edge designs. The transition region is able to pre-compress and smooth the pad before the wafer gets into the area, thereby eliminating the "ringing marks" on the edge of the wafer.

Therefore, while the particular 20-degree angle chamfer combination for structure illustrated in FIG. 13 has shown excellent results for the system described, other modified transition region structures that transition between the parallel and the perpendicular may be optimal for other CMP polisher configurations, including, for example a radially shaped transition confirmation, elliptically shaped conformations, linear transition region having only single chamfer between surfaces 201 and 209, and confirmations which provide different angles and/or more surfaces in the transition region.

Figure 18:
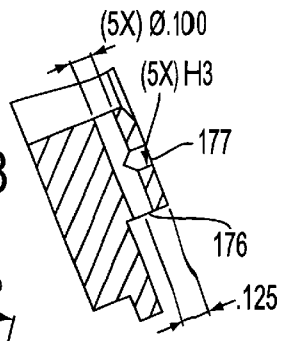
FIG. 18 is a diagrammatic illustration showing a detail of the flushing channels and orifices for clearing polishing slurry from the ring area.
Figure 14:
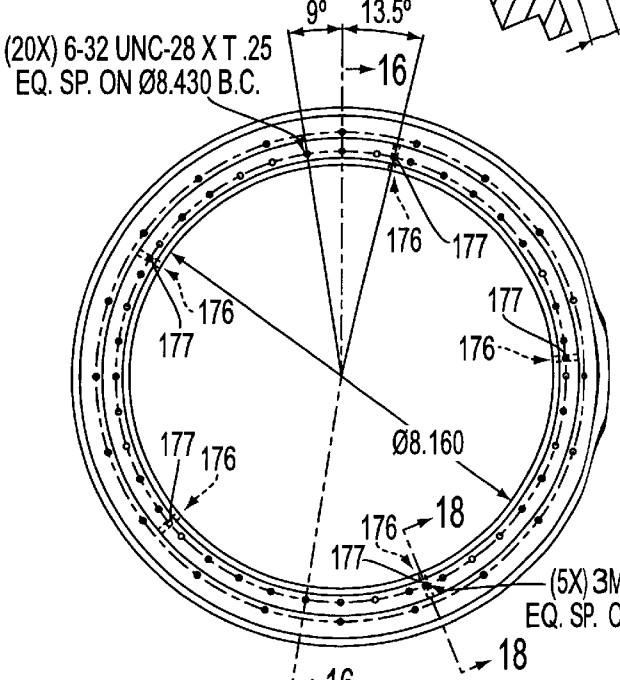
FIG. 14 is a diagrammatic illustration showing an embodiment of the inventive retaining ring adapter used in the polishing head of FIG. 5.
Figure 17:
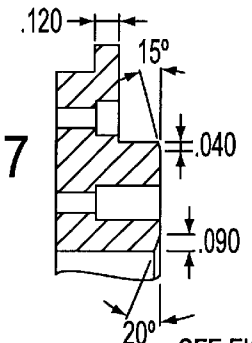
FIG. 17 is a diagrammatic illustration showing a detail of the manner of attaching the retaining ring to the retaining ring adapter in sectional view.
Figure 16:
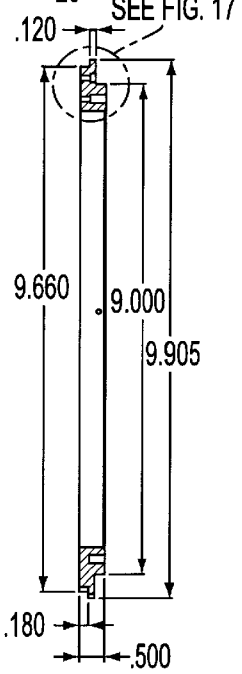
FIG. 16 is a diagrammatic illustration showing a sectional view of the retaining ring adapter in FIG. 14.
Figure 15:
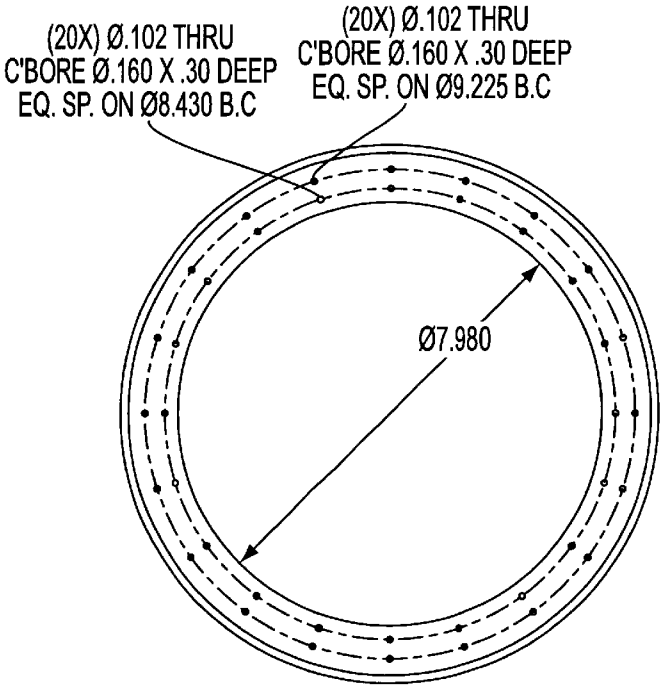
FIG. 15 is a diagrammatic illustration showing an alternative view of the retaining ring adapter in FIG. 14.

We now briefly describe additional details for retaining ring adapter 168 relative to FIGS. 14–18. FIG. 14 is a diagrammatic illustration showing an embodiment of the inventive retaining ring adapter used in the polishing head of FIG. 5, and FIG. 15 shows an alternative view of the same ring. FIG. 16 is a diagrammatic illustration showing a sectional view of the retaining ring adapter in FIG. 14, and FIG. 17 shows a sectional view detail of the manner of attaching the retaining ring to the retaining ring adapter. FIG. 18 shows some additional detail of the flushing channels and orifices for clearing polishing slurry from the ring area.

With reference to these figures, retaining ring adapter 168 is typically formed of metal to provide appropriate strength, dimensional stability, and the like properties of a structure within the head. On the other hand, the retaining ring continuously floats on the surface of the polishing pad during a polishing operation and must be compatible with that environment, and in addition should not deposit material onto the pad that may be harmful to the polishing operation. Such material is typically as softer material, such as the TECHTRON material used in one embodiment of the invention. The retaining ring is also a wear item. Therefore, it is advantageous to provide separate retaining ring adapter and replaceable retaining rings, though in theory an integral structure providing both functions can be used, albeit not with optimum characteristics.

Retaining ring adapter 168, in addition to providing means for attaching retaining ring 166 to primary diaphragm 162, includes a plurality of "T"-shaped channels or orifices for cleaning slurry that may gather: (i) between the subcarrier 160 and retaining ring 166 (and retaining ring adapter 168), or (ii) between retaining ring 166 (and retaining ring adapter 168) and lower housing 122. In the embodiment of the invention illustrated in FIGS. 14–18, five such T-shaped (or inverted T-shaped) channels are provided, disposed at substantially equal intervals around the periphery of the retaining ring adapter 168. The first vertically downwardly extending (approximately 0.115 inch diameter) hole 177 extends downward from an upper surface of retaining ring adapter 168 about 0.125 inches to intersect a second horizontally extending bore 176 (approximately 0.1 inch diameter) that extends between surface 186 adjacent subcarrier surface 185 and surface 196 which opens onto a space continuous with a region between the inner surface of lower housing 122 and the outer radio portions of retaining ring adapter 168.

By forcing deionized water through the first orifice the space between subcarrier and retaining ring is cleared of any slurry, and by forcing water through the second orifice, the region between retaining ring and lower housing is kept clear of slurry. Separate channels and orifices may alternatively be provided extending separately to the ring-housing area and to the ring-subcarrier area, but no particular advantage is provided by such structure. The discharge pressure and volume should be adjusted to produce adequate clearing action. Detail of these orifices is also illustrated in FIG. 18. Means to communicate fluid from an exterior source through rotary union 116 and to the fitting 197 are implementation details and are not shown.

In one embodiment of the invention, five 0.100 inch "T" -shaped holes or channels are provided for head flushing. High-pressure deionized water is forced through the these holes to dislodge and clear any accumulated slurry. A 0.45 inch wide by 0.20 inch step on the top surface of the retaining ring adapter 168 provides sufficient physical space for cleaning water flow to clear slurry deposits and as a result to maintain unrestricted motion of the retaining ring relative to both the carrier and the housing. Free movement of the subcarrier and retaining ring are important for maintaining uniform polishing at the edge of the wafer. The square edge of the subcarrier allows the retaining ring to move separately from the subcarrier and keep certain distance in a vertical direction.

Subcarrier 160 also has additional properties. In one embodiment, subcarrier 160 is a solid round non-porous ceramic disk having a diameter of about eight inches (7.885 inches in one particular embodiment) for the version of the polishing tool applicable to 200 mm wafers. (In an embodiment intended for polishing or planarizing 300 mm semiconductor wafers, the subcarrier has a diameter of about twelve inches (300 mm)). The subcarrier has a square edge on its upper and lower surfaces, and is lower surface is lapped for flatness and smoothness. Six vacuum holes 147 (0.040 in. diameter) are provided in the subcarrier opening onto the lower surface 164 of the subcarrier where the subcarrier mounts the backside of the wafer. These holes are in fluid communication with the single bore 184 at the top center of the subcarrier. The fitting, a male thread 10–32 NPT one touch connector, is provided on the upper surface of subcarrier for connection to tubing through the rotary union and to an exterior source of vacuum, pressurized air, or water.

The holes are formed by boring a first hole 184 into the top surface of the subcarrier 160, then boring six holes radially inward from the cylindrical edge of the subcarrier to the center bore hole 184. Six holes are then bored from the lower surface of the subcarrier upward from the lower subcarrier surface until they intersect the six radially extending holes or bores 191 to complete the connection to the central bore hole 184. The portion of the radially extending holes between the six vertically extending holes and the cylindrical edge over the subcarrier are then filled with a stainless steel plugs 181 or other means to prevent leakage of air, vacuum, pressure, or water. These holes and channels are used to supply vacuum to the backside of the wafer in order to hold the wafer to the subcarrier, and to provide pressurized air or water or a combination of the two to urge the wafer away from the subcarrier during wafer unload operations.

Figure 19:
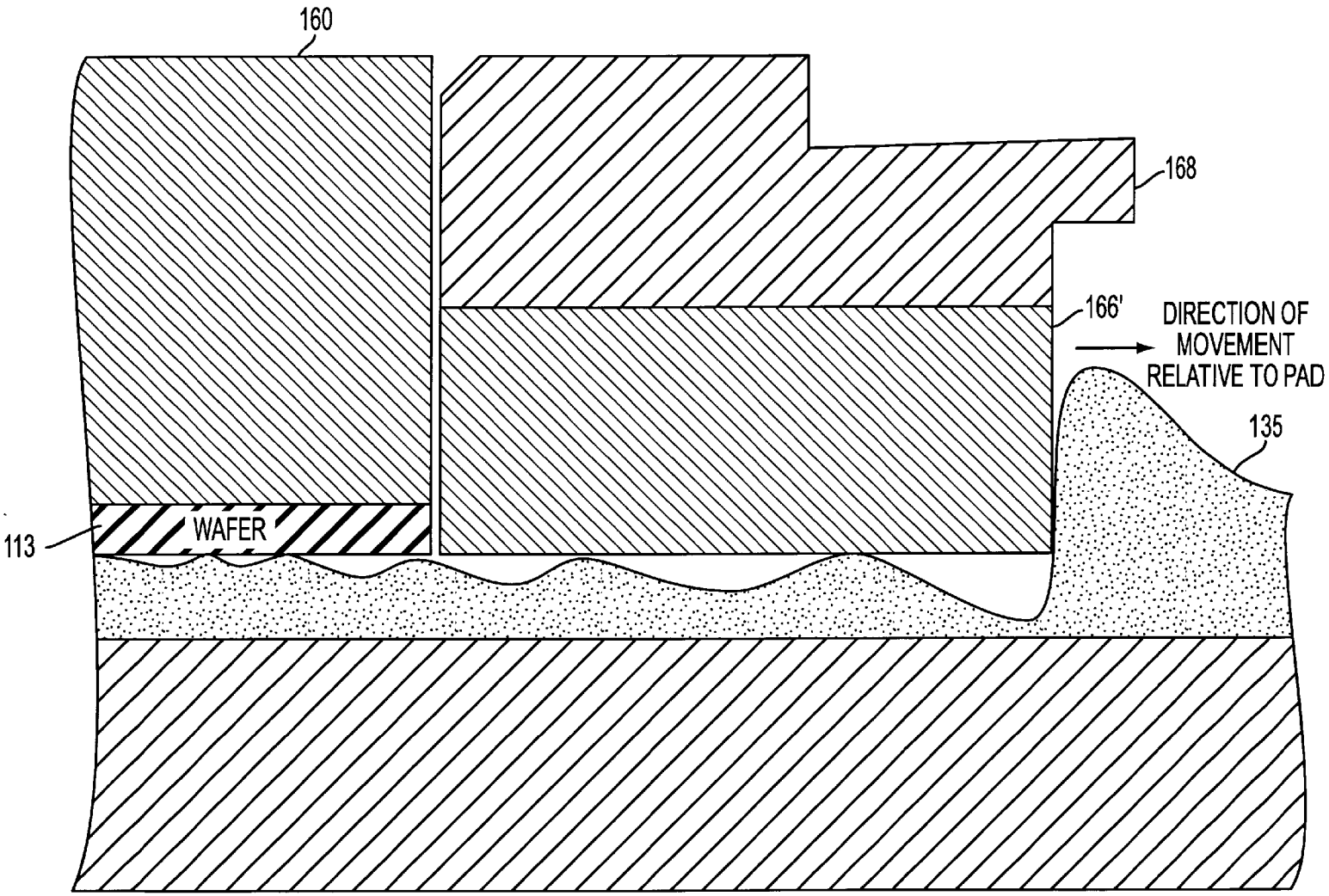
FIG. 19 is a diagrammatic illustration of a hypothesized retaining ring polishing pad interaction for a retaining ring having a square corner at the ring-pad interface.
Figure 20:
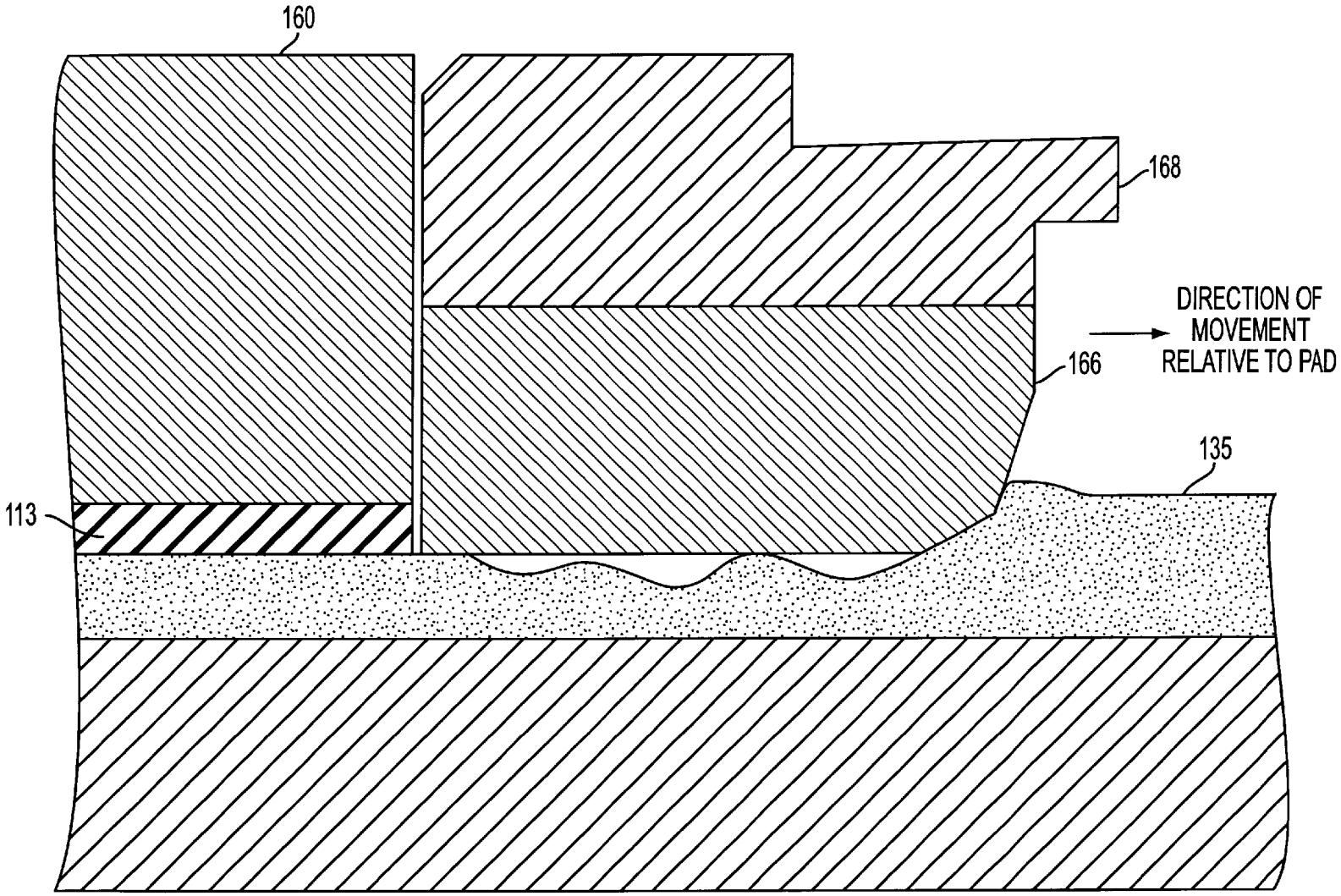
FIG. 20 is a diagrammatic illustration of a hypothesized retaining ring polishing pad interaction for a retaining ring having the inventive multi-planar chamfered transition region at the ring-pad interface.

We now address one explanation for the reason the inventive retaining ring perform so well in conditioning the pad 135. FIG. 19 is a diagrammatic illustration of a hypothesized retaining ring polishing pad interaction for a retaining ring having a square comer at the ring-pad interface. In this example, the square edge of the pad causes the pad to compress and buckle upward as the edge of the ring presses forward and downward against it. The pad experiences the impact of the ring and oscillations develop in the pad that extend to an area beneath the wafer. On the other hand, with the inventive retaining ring illustrated in it is hypothesized that the retaining ring to polishing pad interaction for a retaining ring having the inventive multi-planar chamfered transition region at the ring-pad interface causes fewer oscillations in the pad, or lower magnitude oscillations that die out before reaching the wafer surface. The beneficial effects are also achieved in part by applying only a fractional component of the retaining ring downward pressure at the outer radial edge of the ring, and gradually increasing the pressure as at smaller radii. In effect, the transition region guides the pad under the ring and increases pressure as the pad passes thereby reducing the impact of the ring on the pad and causing a more gradual application of force.

Figure 21:
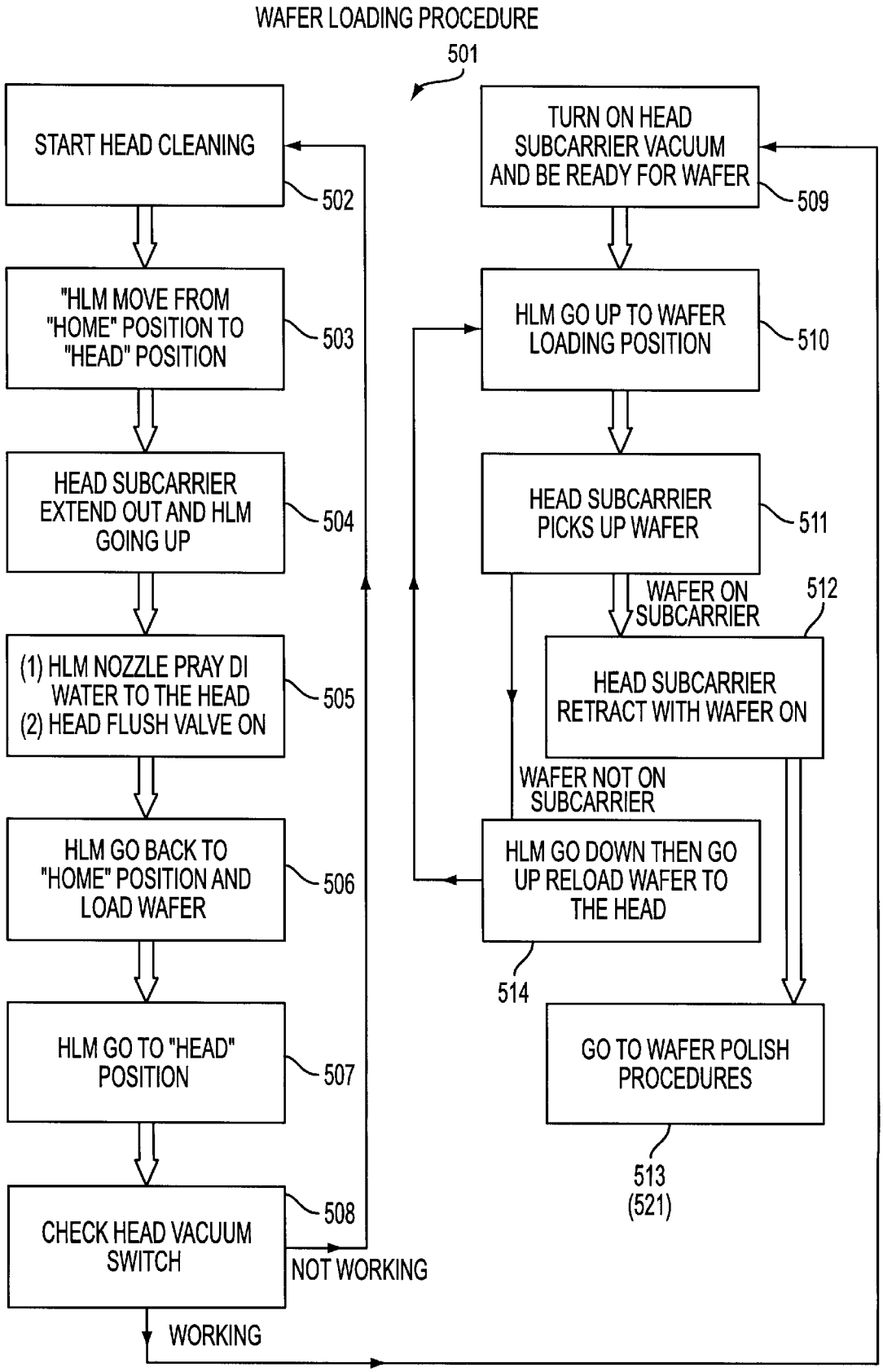
FIG. 21 is a diagrammatic flow-chart illustration of an embodiment of a wafer loading procedure.

We now describe three embodiments of head wafer load/unload and polishing procedures associated with the inventive structure and method. FIG. 21 illustrates a diagrammatic flowchart of the head wafer load procedure 501. It should be understood that this procedure includes several steps which are performed in a preferred embodiment of the invention; however, it should be understood that not all of the steps described are essential steps, rather the several optimal but provide for optimal one-year optimal results in the overall procedure.

Robotic wafer handling equipment is commonly used in the semiconductor industry, particularly where processes are carried out in clean room environments. In this context, a Head Load Module (HLM) and a Head UnLoad Module (HULM) are provided to present wafers to the CMP tool for polishing and to receive wafers from the CMP tool when polishing is completed. Even where the HLM and HULM may be identical robots, two separate machines may be used, one to present clean dry wafers and the second to receive wet wafers coated with polishing slurry. Typically the HLM and HULM include a stationary portion and an articulated arm portion that moves a robotic hand, paddle, or other wafer grasping means in three dimensions, including the ability to rotate. The hand is moved under computer control to move the wafer from a storage location to the CMP tool and back to water or another storage location after polishing or planarization has been completed. The following procedures refer to the manner in which the HLM or HULM interacts with the CMP tool and more specifically with components of the wafer carrier assembly.

First, the loading of a wafer to the head is initiated (Step 502). This includes the controlled movement of the HLM robotic arm from a "home" position to "head" position (Step 503). Home position for the HLM is a position wherein the robot loading arm is outside of the carousel and away from the head. Head position is a position of the robotic arm where the robotic arm is extending beneath the carousel under the polishing head and presenting the wafer to the head for mounting. In Step 504, head subcarrier extends out (downward) under the influence of pressure into chamber P2 132 so that the carrier face extends below the lower edge of the retaining ring; the robotic arm then extends upward to urge the wafer against the carrier face. Springs are provided so that hard contact that might damage the wafer is avoided. Next, HLM nozzle optionally sprays DI water onto the head, and the head flush valve is turned on so that the valve is open for DI water to pass through the valve (Step 505). The HLM then goes back to the "home" position and loads to wafer (Step 506). Then, the HLM goes to "head" position (Step 507). Next, the computer checks the head vacuum switched to verify that is working (Step 508). The working head vacuum switch is important because it ensures that the vacuum is working so that the head is able to pick up the wafer from the extended arm of the robot. If the head vacuum switch is not working the head cleaning cycle is repeated starting at Step 502 until a working head vacuum switch is verified, making sure the head subcarrier vacuum is turned on so as to be ready to receive a wafer (Step 509).

The HLM goes up to the head wafer loading position (Step 510), and head subcarrier picks up the wafer from the HLM (Step 511). Next we determined if he wafer has action been picked up a by the subcarrier applying the vacuum at the back side of the wafer, and if the wafer is on the subcarrier, the head subcarrier retraction with the wafer attached (Step 512) and wafer polishing procedures then began (Step 513). On the other hand, if the wafer is not on the subcarrier, the HLM goes down and then back up in an attempt to reload the wafer onto the head (Step 514) and repeats Steps 510 through 511 until it is verified that the wafer is on the subcarrier.

Figure 22:
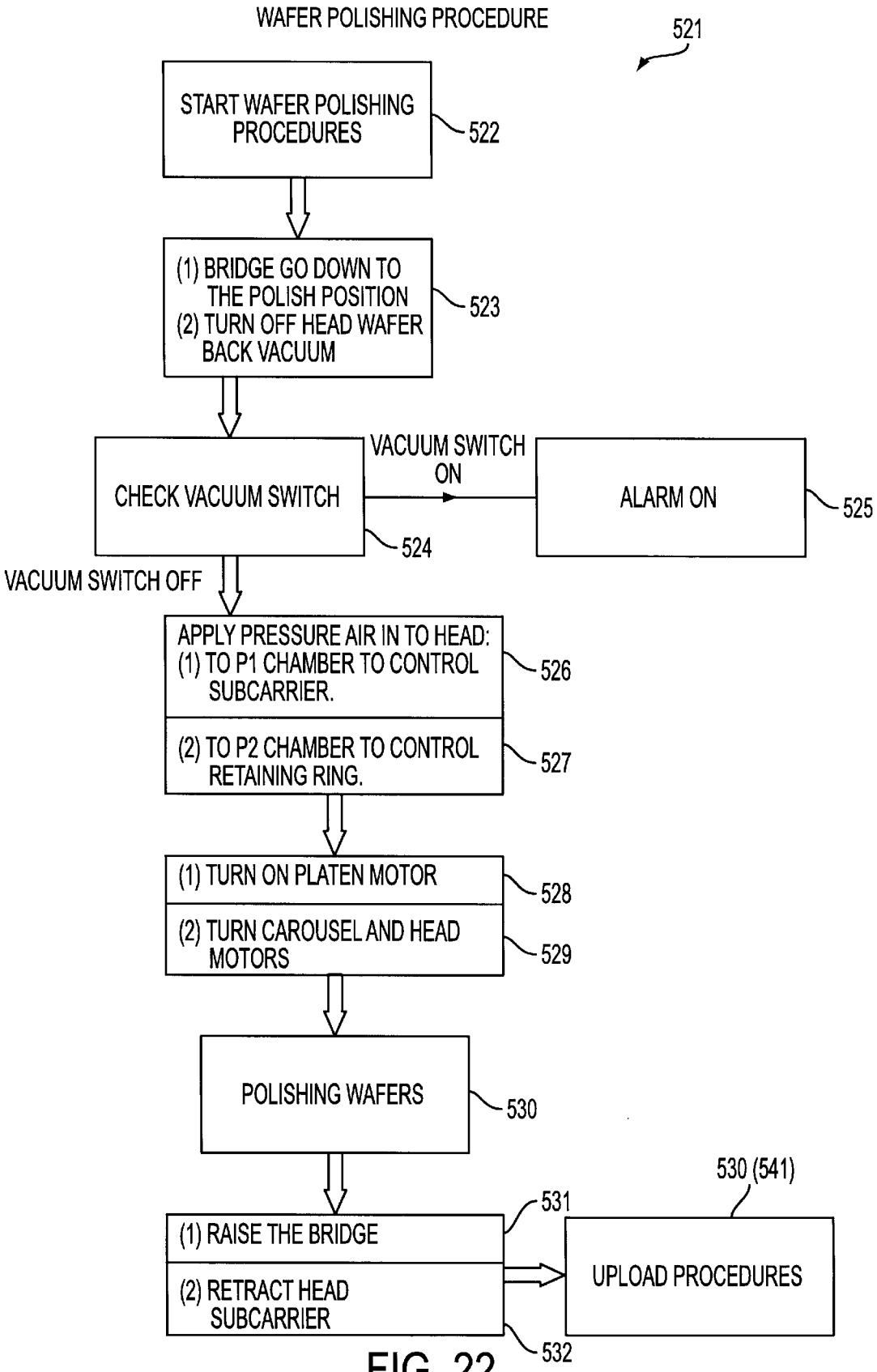
FIG. 22 is a diagrammatic flow-chart illustration of an embodiment of a wafer polishing procedure.

The wafer polishing procedures now described relative to FIG. 22 which shows a diagrammatic flowchart of the polishing procedure (Step 521). Wafer polishing begins after the wafer has been loaded onto the subcarrier as previous described (Step 522). The polishing head attached to the turret and carousel assemblies is moved downward to the polish position so that the wafer is placed in contact with the polishing pad adhered to the platen, and the head wafer backside vacuum which had been on to assisting adhering the wafer to the subcarrier is turned off (Step 523). The vacuum valve then closes and remains closed until just prior to polishing. Then it is opened, uncovered and checked to verify wafer presence prior to polish and then closed again (Step 524). At this stage of the process the vacuum switch should normally be off, and if the vacuum switch is on, alarm is triggered in the form of an audible, and visual, or other indicator (Step 525). After vacuum switch is off, the process proceeds by applying air pressure to each of the two chambers in the head chamber P1 and chamber P2 (Steps 526, 527). The air or other fluid pressure applied to chamber P1 controls the pressure or force on the subcarrier and as a result the polishing pressure exerted on the front surface of the wafer against the opposing surface of the polishing pad (Step 526). The air or fluid pressure applied to chamber P2 controls be pressure exerted against the retaining ring, which pressure serves both to maintain the wafer within a pocket defined by the retaining ring and to place the polishing pad in the immediate vicinity all of the edge of the wafer into a condition optimal for polishing the wafer and eliminating non-linear polishing effects at the edge of the wafer (Step 527).

In embodiments of the invention including the inventive chambered wafer subcarrier, air pressure is applied to chamber P3 (an in multiple-chambered configurations to each of the other subcarrier chambers) to further control the pressure or force on the edge of the subcarrier and as a result the polishing pressure exerted on the circumferential portion of the front surface of the wafer against the opposing surface of the polishing pad. Likewise, in multi-grooved multi-chambered embodiments, air pressure is applied to each subcarrier chamber to control the pressure or force on each zone of the subcarrier and as a result the polishing pressure exerted within zones (usually annular zones) of the front surface of the wafer against the opposing surface of the polishing pad.

Returning to a discussion of the non-chambered subcarrier, once appropriate pressures in the two chambers has been established the platen motor is energized (Step 528), and the carousel motors and head motors are energized (Step 529) to cause rotation all the platen carousel and head motors in a predetermined manner and thereby initiate polishing of the wafer's (Step 530). After the wafers have been polished, the heads and carousel (attached to a bridge assembly) are raised away from the polishing pad (Step 531), and head subcarrier is retracted from the lowest position to the highest position inside the head so that the wafer can be easily separated from the pad (Step 532). The polishing having completed wafer unloading procedures are initiated (Step 530).

Figure 23:
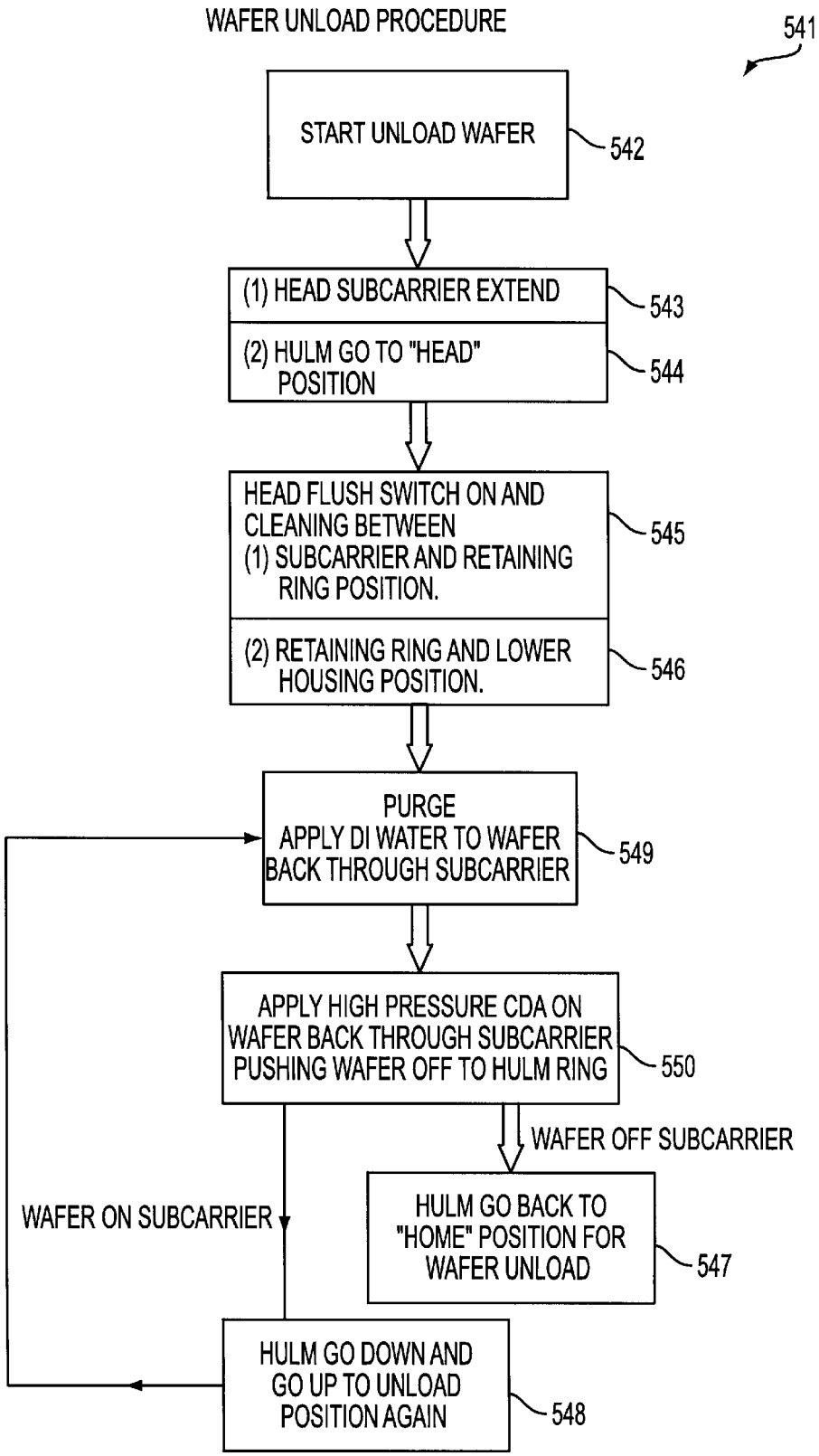
FIG. 23 is a diagrammatic flow-chart illustration of an embodiment of a wafer unloading procedure.

Wafer unload procedures (Step 541) are now described relative to the diagrammatic flowchart in FIG. 23. Wafer unload begins (Step 542) by extending the head subcarrier towards the Head UnLoad Module (HULM) (Step 543). Next, the HULM is moved to a "head" position (Step 544). Next a head flush operation is initiated to clean spaces between the subcarrier and retaining ring (Step 545), and between portions of retaining ring and the lower housing (Step 546). The head flush switch "ON" operation clauses the deionized (DI) water to be sent under pressure from an external source to the rotary union 116 (including spindle 119) and into the head through mounting adapter 121 and communicated via tubing and fittings to carrier-ring flush orifices and to ring-housing flush orifices. A purge operation (Step 545) is also performed by applying deionized water to be backside of the wafer through a central bore 184 at the upper surface of the subcarrier and via radially extending bores or channels 191 and holes 147 extending from the central bore to the subcarrier-wafer mounting surface. When an optional insert is provided between the subcarrier-wafer mounting surface and the backside of the wafer, holes are also provided through the insert so that deionized water, pressurized air, or vacuum may be applied through the insert. The purge operation also includes application of high-pressure clean dry air (CDA) the through the subcarrier holes to push off the wafer onto to the HULM ring which has been brought into proximity to receive the wafer as is pushed off the subcarrier (Step 546). If after this first purge operation the wafer has been urged off of the subcarrier and onto the HULMH, then the HULM is moved back to its "home" position (Step 547). Unfortunately, the single purge cycle may not always be sufficient to urge the wafer from the subcarrier, and in such instance the HULM is moved downward. The procedures are repeated beginning at Step 545 with additional purge cycle's until the wafer has been removed from subcarrier and is captured by the HULM.

Alternative Embodiments—Chambered Subcarrier

Having now described several embodiments of a structure and method of a chemical mechanical polishing (CMP) head assembly having a floating wafer carrier (or subcarrier) and retaining ring, we now turn our attention to several additional alternative embodiments. The particular additional alternative embodiments described immediately below are directed toward a substrate subcarrier such as a semiconductor wafer subcarrier, which we will for convenience refer to as a grooved subcarrier 160' having some features that are the same as the features of subcarrier 160 already described and some additional features. These additional features as well as changes to the chemical mechanical polishing head assembly that are required to implement the additional inventive subcarrier are described in detail hereinafter.

Figure 24:
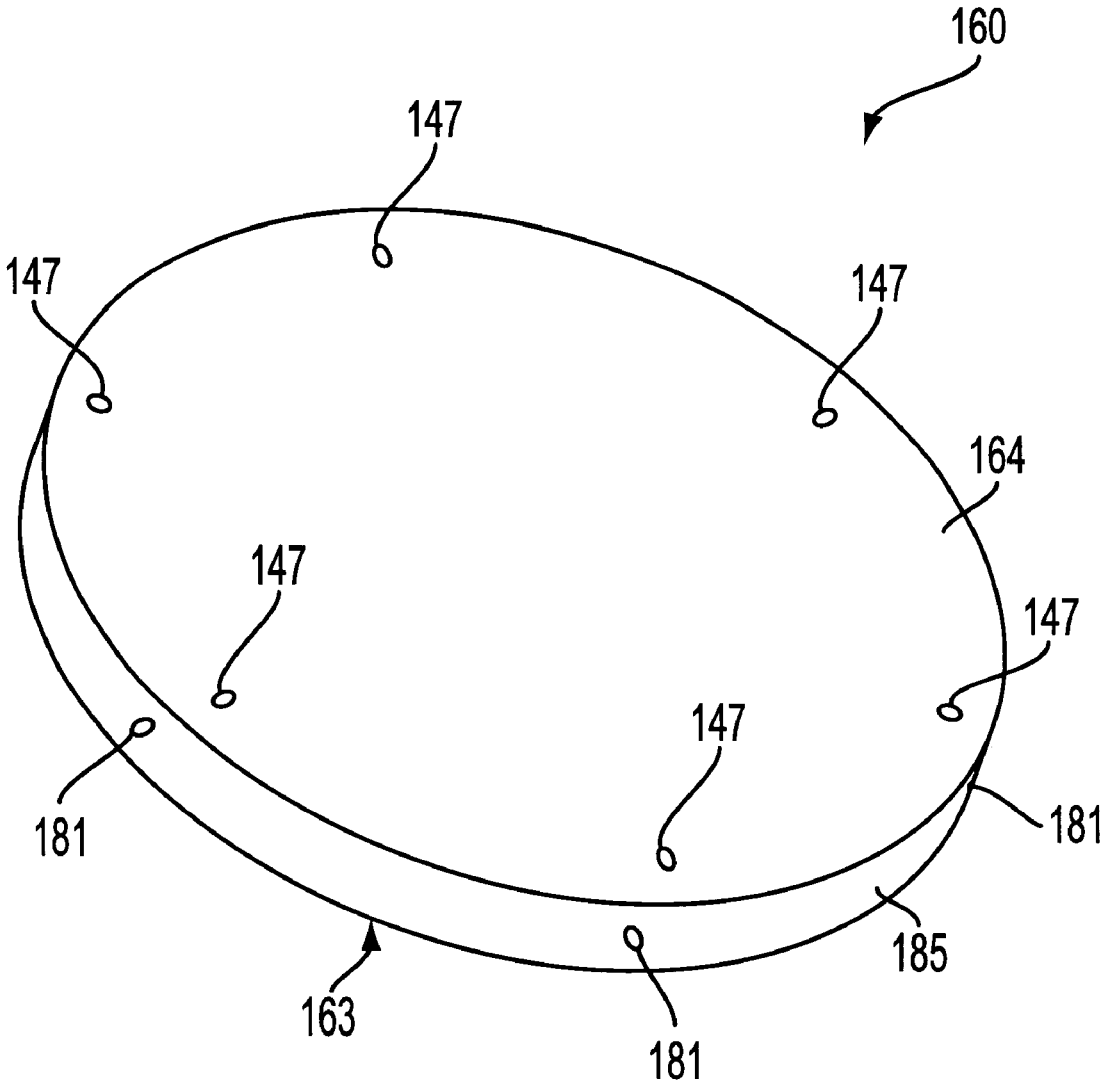
FIG. 24 is a diagrammatic illustration showing the wafer receiving surface of one non-grooved embodiment of the inventive wafer subcarrier.

We first review some of the features of subcarrier 160 relative to FIG. 24 and already described so that the additional features provided by grooved subcarrier 160' may be more readily understood. In one embodiment, subcarrier 160 is a solid round non-porous ceramic disk having a diameter appropriate to mount or carry 200 mm or 300 mm semiconductor wafers. Subcarrier 160 has heretofore been described relative to a two-pressure chamber embodiment of a polishing head. A first pressure chamber exerts a pressure against the retaining ring assembly and a second pressure chamber exerts a pressure against the subcarrier and indirectly against the wafer. Subcarrier 160 has a square edge between a cylindrical side 185 and adjacent upper surface 163 and lower surface 164. Lower surface 164 is advantageously lapped for flatness and smoothness. In FIG. 24, the lower surface 164 projects out of the drawing so that surface features to be described subsequently relative to the grooved subcarrier 160' are more readily shown.

Fluid communication channels are provided in the subcarrier 160 connecting with holes or orifices 147 opening onto the lower surface 164 of the subcarrier. These holes communicate a vacuum to assist in picking up and holding a wafer 113 to the subcarrier (possibly with an intervening optional polymeric or other flexible membrane insert) from the backside of the wafer. The holes may also be used to pass pressurized air or fluid to assist in releasing the wafer from the subcarrier. These holes are in fluid communication with the single bore 184 at the top center of the subcarrier 160 via six radially extending bores 191 to complete the connection to the central bore hole 184. The portion of the radially extending bores between the six vertically extending holes 147 and the cylindrical edge 185 of subcarrier 160 are then filled with a stainless steel plugs 181 or other means to prevent leakage of air, vacuum, pressure, or water. Of course the number of holes 147 can be any number of holes such that appropriate vacuum/pressure is developed without distorting either the subcarrier or the wafer. The manner in which vacuum/pressure is communicated from external sources via the rotary union to the rotating head and subcarrier has already been described.

Figure 25:
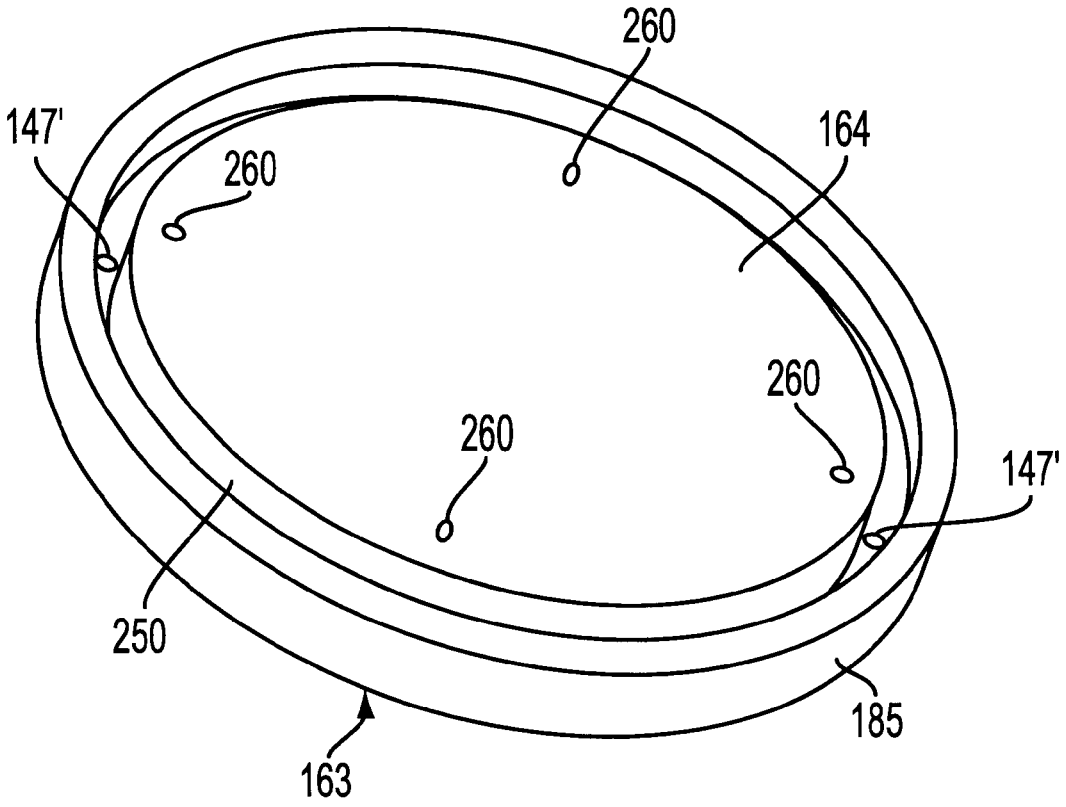
FIG. 25 is a diagrammatic illustration showing the wafer receiving surface of a single-grooved single-pressure chambered embodiment of the inventive wafer subcarrier.
Figure 26:
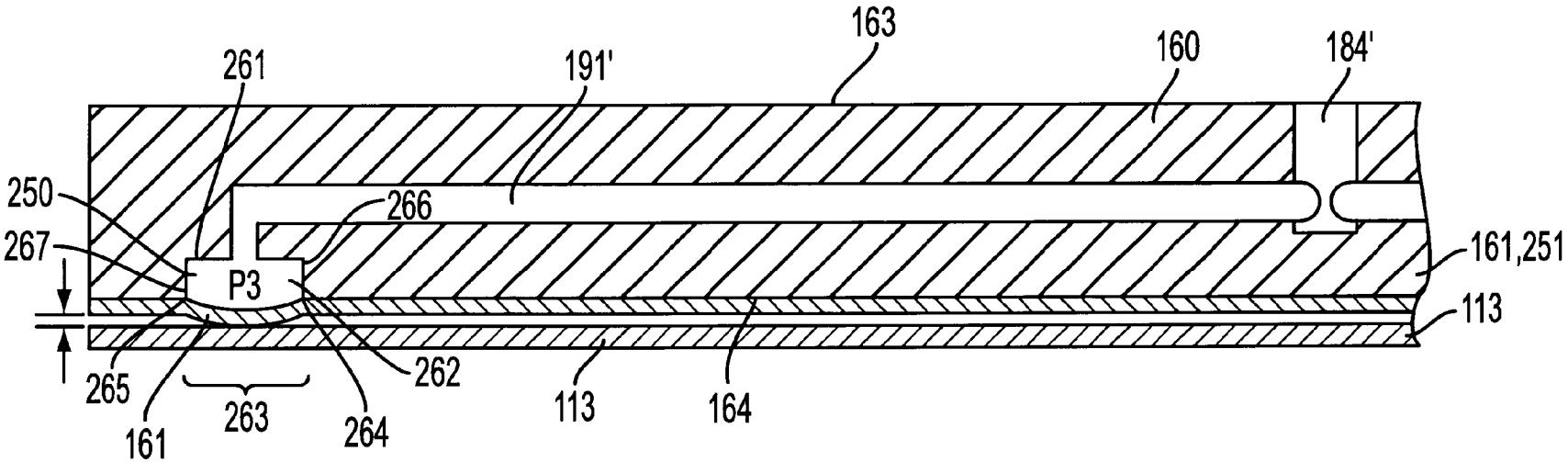
FIG. 26 is a diagrammatic illustration showing a partial sectional view of the single-grooved single-pressure chambered wafer subcarrier in FIG. 25.

We now describe the alternative grooved subcarrier 160' relative to FIG. 25 which is a perspective view of subcarrier 160' looking generally at the lower surface 164, and FIG. 26 which is a partial sectional view through the subcarrier. This embodiment of the invention is directed toward obtaining even greater uniformity of the wafer at or near the peripheral edge of the wafer. Even when the inventive floating retaining ring assembly and floating carrier are used as described, there may be some minor residual non-uniformity or unevenness in polishing at or near the wafer edge. This residual amount is typically on the order of one (1) micron or less and frequently on the order of about 0.1 micron, although it may be more or less.

Subcarrier 160' is an improved implementation of a subcarrier which may be used alone or in conjunction with the afore described head mounting assembly 104 and wafer carrier assembly 106 including retaining ring assembly 167. The primary change in subcarrier 160' relative to subcarrier 160 is the addition of a groove, cavity, or depression 250 which when used in combination with a generally non-porus sheet of material 251 forming a resilient or flexible membrane, forms a third pressure chamber 252 that expands, or attempts to expand, when positive pressure is applied to exert a force on the backside of wafer 113 and to thereby increase the polishing pressure force or pressure on the wafer near the groove 250. We refer to this pressure as the edge transition chamber pressure (ETC). In some instances it may be desirable to apply a negative pressure or vacuum to the groove and when the sheet of material 251 is at least somewhat compressible, to reduce the polishing pressure in an annular region adjacent the groove. In some embodiments of the invention, the non-porus sheet of material 251 may for example be an insert 161 such as is customarily used in the wafer polishing industry. The Rodel DF200 insert or backing film or the R200 backing film may be used, for example, as the sheet of material 251. The Rodel DF200 (Rodel Part No. A00736, Product Type DF200) has a 23–27 mil (0.58 to 0.69 millimeter) nominal thickness, a compressibility of from about 4.0 to 16.0 percent, and provided as a medium tack double coated polyester with a synthetic rubber based high shear adhesive. The clean room version of this insert has a non-particular generating 0.002 inch silicone PET release liner which is removed during application.

By adjusting the volume of fluid injected into this chamber or by altering the pressure within this third pressure chamber P3, the amount of material removed from the wafer may be optimized to achieve a more uniform polished or planarized substrate (wafer) surface. Additional embodiments of the grooved subcarrier having either multiple grooves, such as concentric grooves, sharing a common pressure source, or multiple grooves each having a separate pressure source. The later multi-groove embodiment (See FIG. 27) permitting an adjustable polishing force profile to be provided at different radial distances from the center to the edge of the wafer.

The manner in which pressure developed within groove 250 cooperates with non-porus sheet material 251, 161 and wafer 113 is schematically illustrated in FIG. 26. Pressurized (positive or negative pressure) fluid such as a pressurized gas or liquid, but usually positively pressurized air is introduced into wafer carrier assembly 106 via an available port of the rotary union, tubing, and fittings, to central bore 184'. From central bore 184' the pressurized air is communicated to one or more radially extending bores 191' which intersect with a similar plurality of holes that extend from the radially extending bores 191' to intersect with groove 250 on the lower surface of the subcarrier. While a single channel may be used to communicate the pressurized air to the groove, the desirability of maintaining uniform pressure throughout the groove and the structural advantages of keeping the dimensions of void areas within the subcarrier small, suggests that several channels, in this particular embodiment six channels, be provided.

It is noted that in this particular embodiment, central bore 184', radially extending bores 191', and a portion of holes 147' appear to be the same structures as were earlier described relative to the wafer backside vacuum/pressure application structures, except that for the embodiment now described, the central bore communicates with a different pressure source, the holes 147' open into the channel 250 rather than directly onto the lower subcarrier surface, and the backside vacuum/pressure is provided by a separate vacuum pressure circuit opening onto four new holes 260. These changes have been provided since the location of groove 250 relative to the edge of the subcarrier and the uniformity of the pressure applied to the groove is more important than the location of the wafer backside vacuum/pressure holes 147 in the earlier described embodiment. In fact the adaptation of the structures was merely a matter of convenience and those workers having ordinary skill in the art will appreciate in light of this disclosure that while the locations of the groove(s) and backside vacuum/pressure holes are important, the manner in which pressure and vacuum are provided to these structures is not as important so long as the physical integrity and stability of the subcarrier is maintained.

With further reference to FIG. 26, the thin substantially non-porus sheet of material 251, here insert 161, acts to close the groove to form a third chamber (P3) 262 so that a pressure can be developed within the chamber. Normally, pressure is only applied to the chamber only when a wafer 113 is mounted to the subcarrier and the wafer is in contact with the polishing pad, so there is no requirement to mount insert 161 to the lower subcarrier surface beyond conventional insert mounting methods as the pressure developed within chamber P3 262 is not sufficient to separate the insert from the subcarrier. The increase in pressure in chamber P3 causes a slight expansion or swelling in the size of the chamber and the resilient insert expands somewhat to press the portion of the wafer 263 in contact with that region of the insert. Where the groove is an annular groove, this pressing occurs uniformly in an annular region of the entire wafer. In FIG. 26, the amount of swelling of the insert and the deflection of the wafer are exaggerated so that the operating principle can be illustrated in the drawing, since typically the variation in material removed over the surface of the wafer is typically less than about one micron, and usually about one-tenth micron or less. Therefore, the actual swelling may be imperceptible, yet a somewhat greater polishing force is effectuated.

In the embodiment illustrated in FIG. 26, groove 250 is shown as a square cut or rectangular groove, however it will be appreciated that while the dimensions of the groove, particularly at the surface of the subcarrier where the edges 264, 265 of groove 250 contact insert 161, the shape of the groove is not critical. For example, the groove illustrated has two substantially vertical sides 266, 267 and a ceiling portion 268. However, grooves having non-vertical or non-planar sides and ceilings may be employed, such as v-shaped, c-shaped, or other non-planar conformations of a groove. The manner in which the groove opens onto the lower subcarrier surface 164 may also be modified to minimize any effect the surface discontinuity may present, if any.

Figure 28:
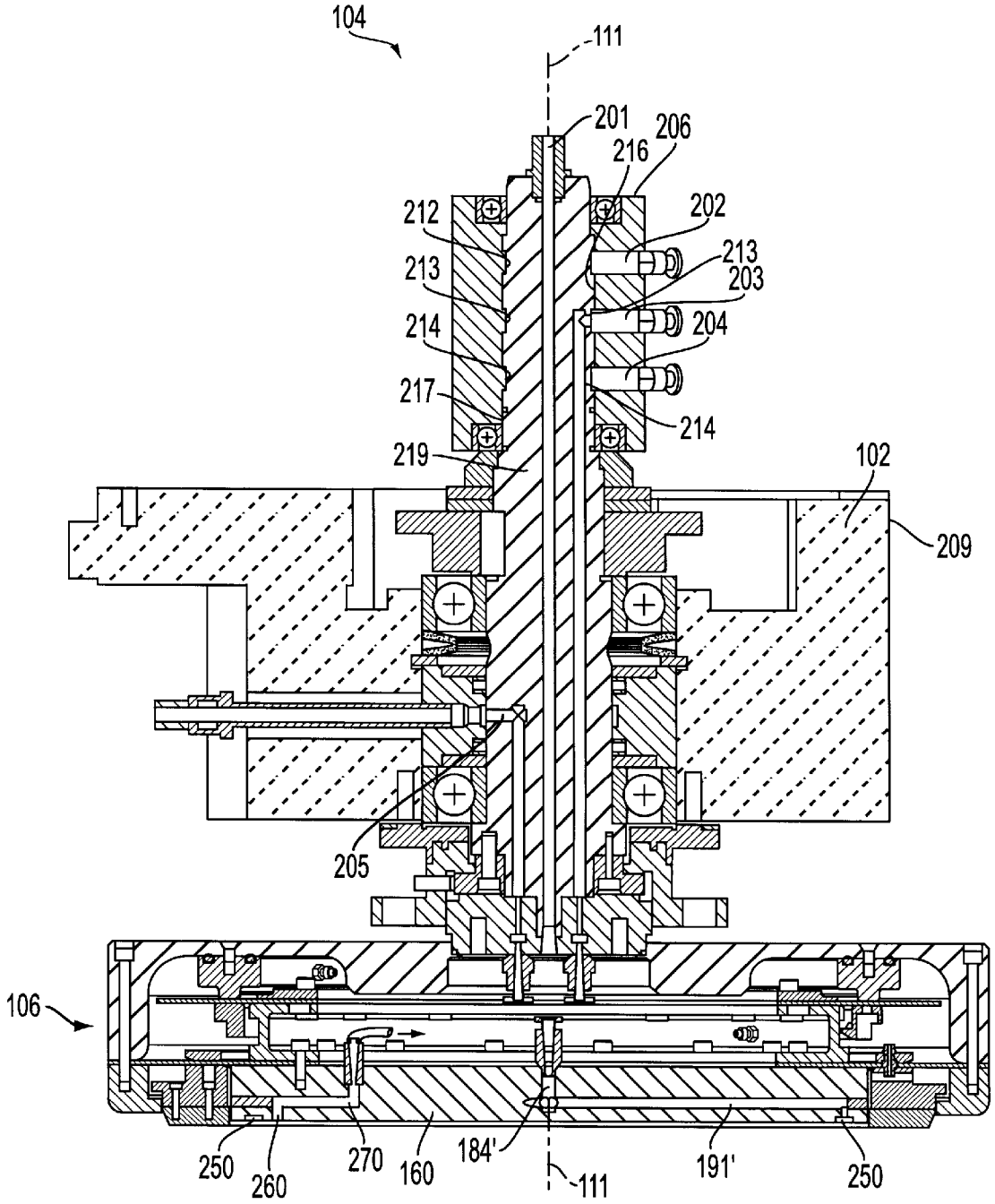
FIG. 28 is a diagrammatic illustration showing a sectional assembly drawing of embodiments of portions of the carousel, head mounting assembly, rotary unions, and wafer carrier assembly, including the single-grooved single-chambered wafer subcarrier.
Figure 29:
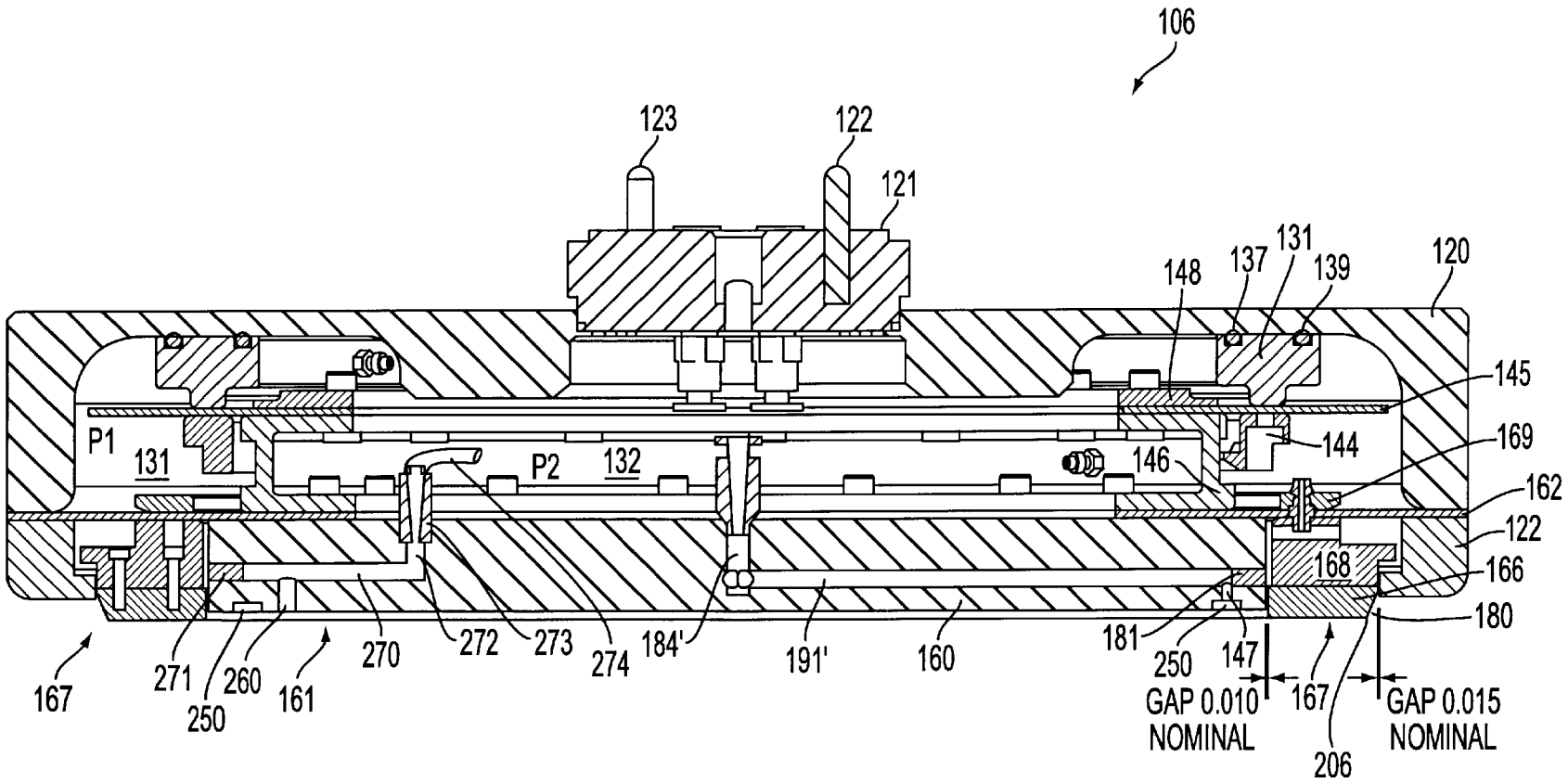
FIG. 29 is a diagrammatic illustration showing a more detailed sectional view of an embodiment of the inventive wafer carrier assembly in FIG. 28.

The four wafer backside vacuum/pressure holes 260 illustrated in FIG. 25 are not visible in FIG. 26 due to the location of the cutting plane for the sectional view; however, these holes 260 are visible in FIG. 28 and FIG. 29 which shows a sectional assembly drawing of embodiments of portions of the carousel, head mounting assembly, rotary unions, and wafer carrier assembly, including this alternative grooved subcarrier. Recall that in the earlier described non-grooved embodiment of the subcarrier, six vacuum holes 147 (0.040 in. diameter) were provided in the subcarrier opening onto the lower surface 164 of the subcarrier where the subcarrier mounts the backside of the wafer. In this grooved subcarrier, a set of four holes 260 are provided and function in analogous manner. Each hole 260 extends vertically from the lower subcarrier surface 164 to intersect a channel 270 extending radially inward from the edge of the subcarrier. One end of the channel 270 is plugged 271 to form an air and liquid tight seal, while the other end extends to intersect a second vertical bore 272 extending to the upper subcarrier surface 163. The manner in which the holes are formed has been earlier described and is not repeated here. It is noted that the structure provides an offset between the location of the holes on the lower and upper subcarrier surfaces so that the fittings 273 do not interfere with the flange ring 146 or other structures present. In principal, vertical bores straight through the subcarrier may be provided to communicate the pressurized air, water, or vacuum to the wafer. A fitting 273 is attached to the subcarrier bore 272 and to tubing 274 so that the vacuum or pressure may be communicated to the holes 260. In one embodiment of the invention the tubing from each of the four holes is connected together within the wafer carrier assembly 106 and then via a common tube to an external source of vacuum, pressurized air, or water via the rotary union. These holes and channels are used to supply vacuum to the backside of the wafer in order to hold the wafer to the subcarrier, and to provide pressurized air or water or a combination of the two to urge the wafer away from the subcarrier during wafer unload operations.

When the sheet of material 251, such as an insert 161 is used to complete formation of the third chamber P3, holes are provided within the sheet of material so that vacuum, pressurized air, and/or water can be communicated directly to the backside wafer surface.

In some embodiments of the invention, groove 250 has dimensions of between about one-twenty-fifth of an inch and about one-tenth of an inch deep and between about one-tenth of an inch and one-half inch wide, but the width may be larger or smaller and the depth shallower or deeper. Embodiments of the invention wherein the groove is between about 0.04 inches (about 1 mm) and about 0.08 inches (about 2 mm) deep and either 0.12 inches, 0.14 inches, or 0.16 inches wide, have also produced improved polishing results compared to non-grooved or flat subcarriers. In another particular embodiment, the groove is about 0.12 inches (about 3 mm) wide. In another particular embodiment, the combination of a 0.08 inch deep by 0.16 inch wide groove centered at a radial distance of 3.64 inches from the center of the 200 mm diameter wafer subcarrier provides good performance. For a 300 mm diameter wafer subcarrier, the groove is located at a proportionate location from the center so that edge polishing effects are similarly controlled.

Figure 30:
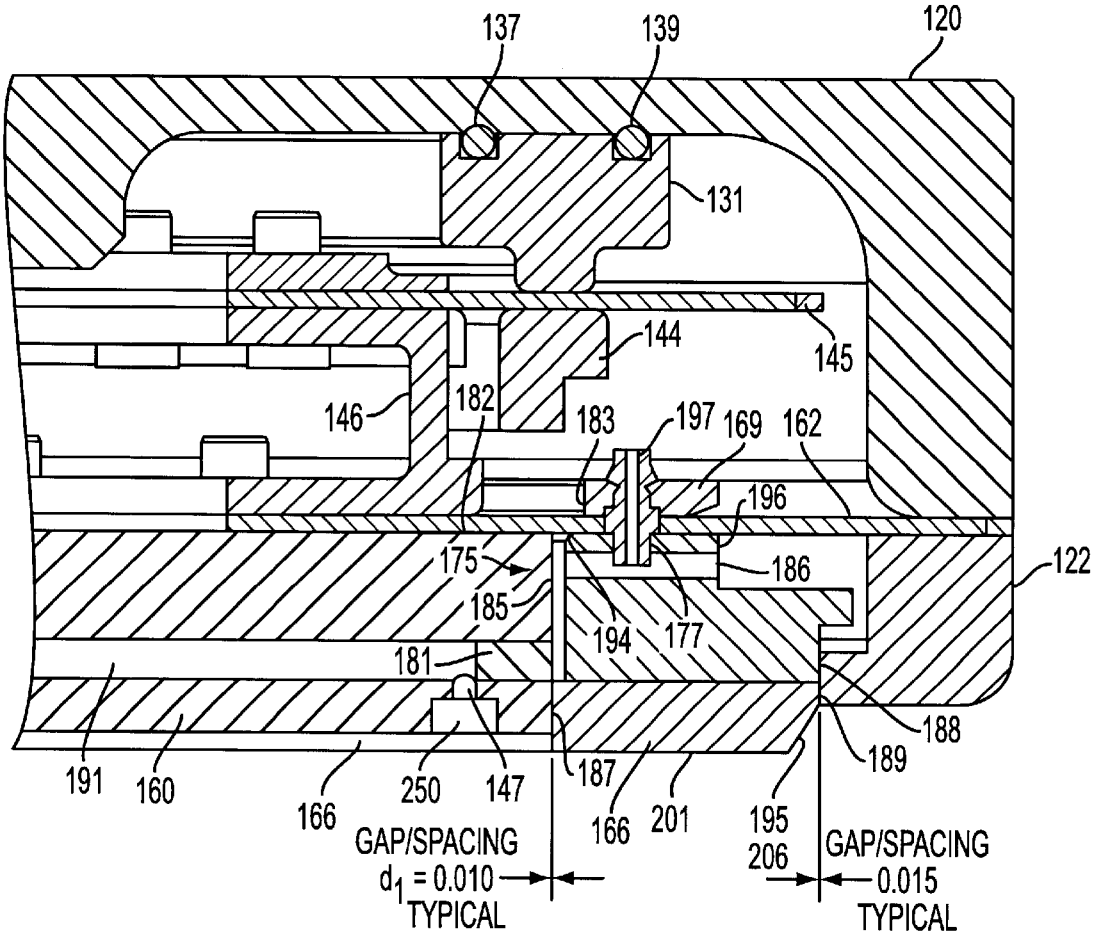
FIG. 30 is a diagrammatic illustration showing a detailed sectional view of a portion of the embodiment of the wafer carrier assembly of FIG. 29.
Figure 31:
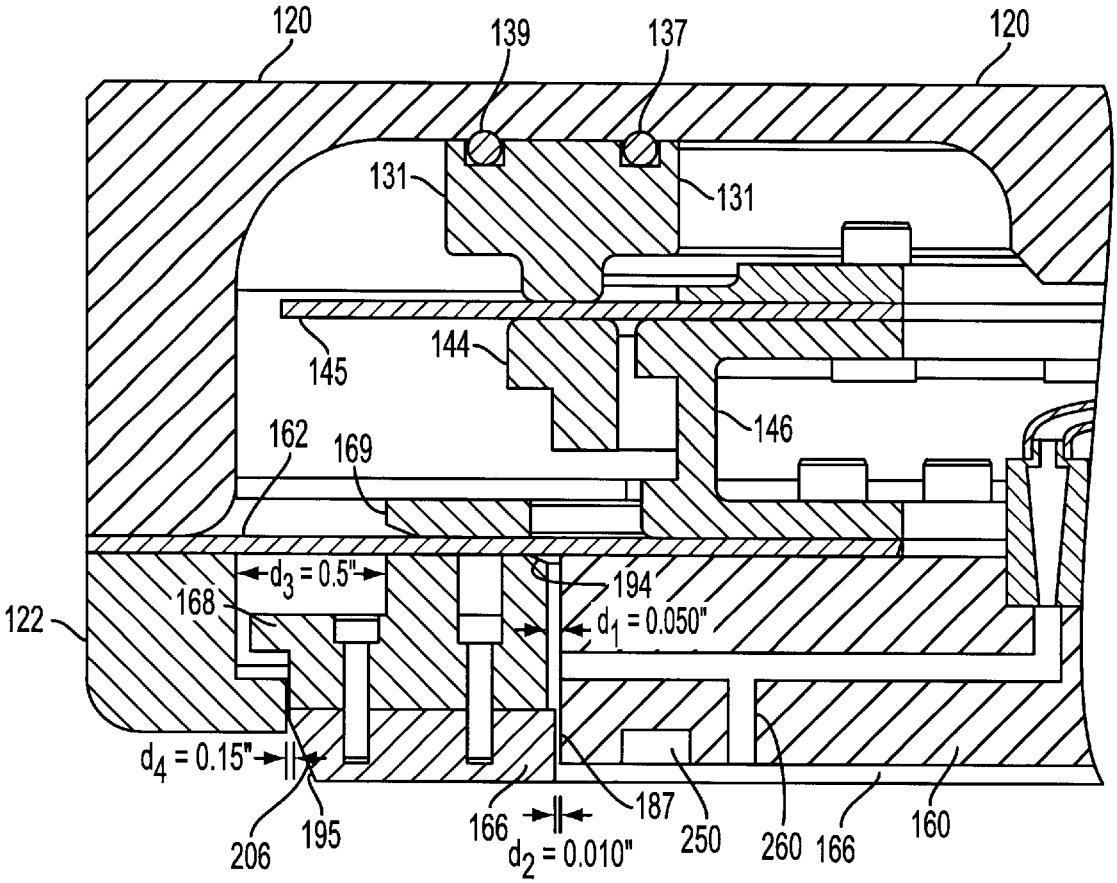
FIG. 31 is a diagrammatic illustration showing a detailed sectional view of a different portion of the embodiment of the wafer carrier assembly of FIG. 29.

The inventive groove structure 250 may generally be from about 0.02 inches (about 0.5 mm)deep to about 0.2 inches (about 5 mm) deep or more, more typically between about 0.02 inches and about 0.1 inches deep, and desirably between about 0.05 inches and 0.08 inches deep. The groove should be sufficiently deep that when the resilient insert 161 is placed on the subcarrier lower surface 164 and the wafer 113 mounted thereto, any intrusion of the insert 161 into groove 250 that may occur during polishing is less than the depth of the groove so that such intrusion does not obstruct substantially uniform application of pressure to the groove and to pressure chamber P3. On the other hand, groove 250 should not be so deep that the structural rigidity or flatness of the subcarrier is compromised. Within these functional constraints, the groove may be any depth. Details of the groove 250 and wafer backside holes 260 are illustrated in FIG. 30 and FIG. 31. Other than the addition of the groove 250, holes 260, and channels connecting these structures to the rotary union, the structures illustrated in FIGS. 28–31 are substantially the same as earlier described relative to FIGS. 4–5, and FIGS. 7–8, and not repeated here. One additional port in the rotary union is required to provide the pressure for the third chamber P3.

Figure 32:
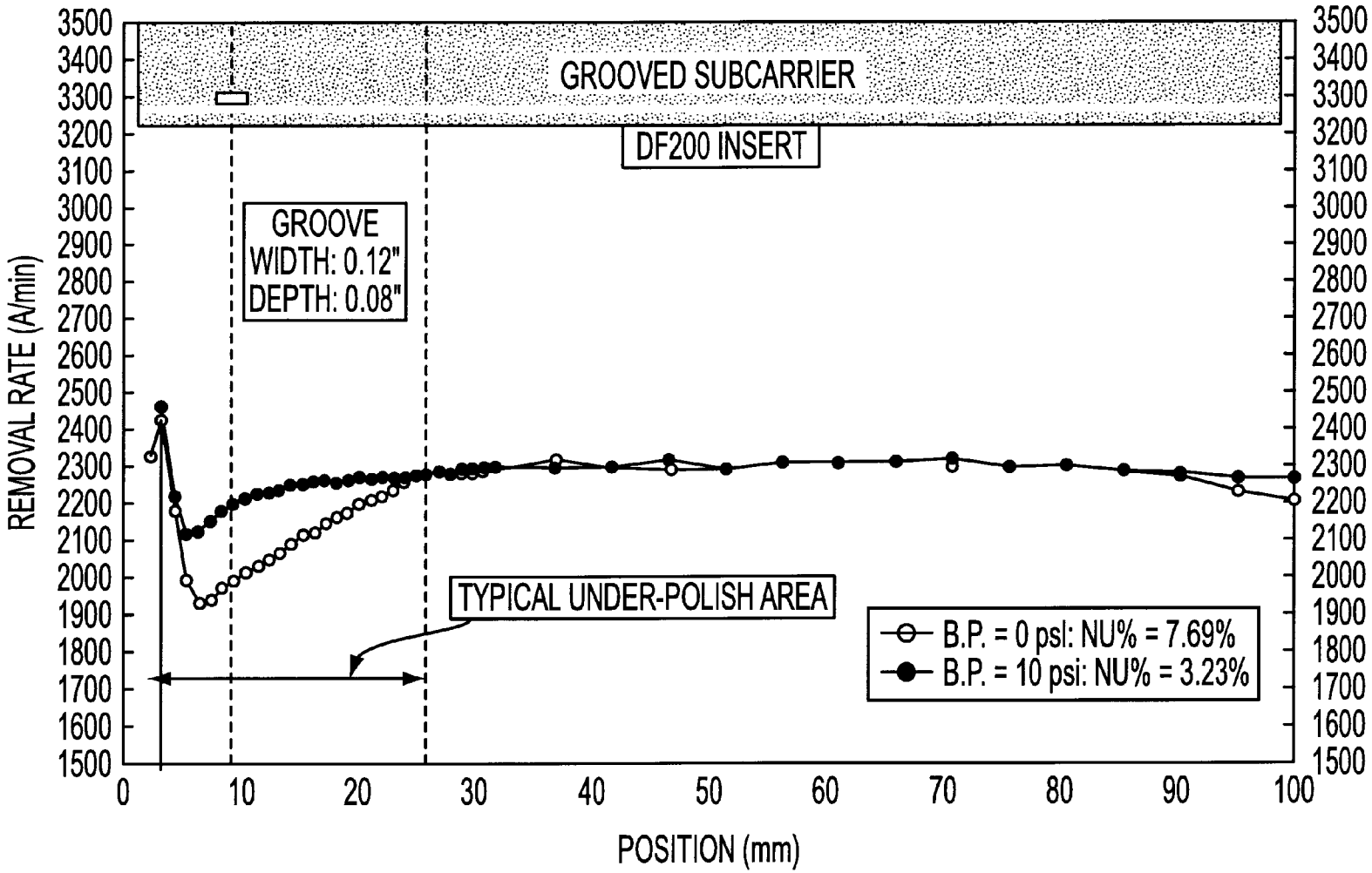
FIG. 32 is a diagrammatic illustration showing the effect of subcarrier groove pressure on the rate of removal as a function of position.

Experimental data showing the difference in the polishing profile for an oxide wafer using a grooved subcarrier having a 0.12 inch wide by 0.08 inch deep groove and 10 psi pressure versus a the same grooved subcarrier having 0 psi pressure and equivalent to a non-grooved subcarrier are illustrated in FIG. 32. Some exemplary performance results are provided in Table I, and the process parameters for which these results apply are listed in Table II. In these tables, SS12 is a designation for a polishing slurry distributed in the United States by Rodel, Klebosol130N50 PHN is a different polishing slurry made by Cabot. The 49 point 5 mm-EE is the a standard testing procedure wherein forty-nine measurements are made on the face of the wafer with a 5 mm edge exclusion (EE) and the 49 point 3 mm-EE is another standard testing procedure wherein forty-nine measurements are made on the face of the wafer with a 3 mm edge exclusion. These procedures are known in the art and not described further here.

TABLE I

Exemplary performance results for exemplary grooved carrier and two different polishing slurries.

| | 49 point 5 mm-EE test | | 49 point 3 mm-EE test | |
|---|---|---|---|---|
| Slurry/ Performance | Removal Rate | Non-Uniformity | Removal Rate | Non-uniformity |
| SS12 | 2850 Å/min | 4.23% | 2980 Å/min | 3.88% |
| Klebosol 30N50 PHN | 1890 Å/min | 2.47% | 1950 Å/min | 2.50% |

TABLE II

Process Parameters for the performance results in Table I.

| | Pressure (psi) | | | Rotational Speed (rpm) | | |
|---|---|---|---|---|---|---|
| Slurry | H.P. | RR.P. | ETC.P. | Platen | Head | Carousel |
| SS12 | 5.5 | 6.0 | 10 | 30 | 24 | 6 |
| Klebosol 30N50 PHN | 5.5 | 4.0 | 10 | 30 | 24 | 6 |

*H.P. = Head pressure, RR.P. = Retaining Ring Pressure, ETC.P. = Edge Transition Chamber Pressure (nominal ETC.P. range is 0–15 psi)

It is noted in FIG. 32 that for nominal ambient pressure (0 psi) the percent non-uniformity (NU%) is 7.69%, whereas when the groove pressure is increased to 10 psi, the percent non-uniformity (NU%) is 3.23% and is smaller by more than half from that of the zero pressure (equivalent to the non-grooved subcarrier) performance. For example, from the graph of FIG. 32, at both 0 psi and 10 psi, the average removal rate for the wafer is about 2300 Angstroms/minute, whereas for 0 psi the minimum removal rate of about 1920 Angstroms/minute at about 6 mm distance from the edge of the wafer becomes about 2110 Angstroms/minute at about 5 mm from the edge of the wafer. While this is merely exemplary of the advantageous results achieved by one embodiment of the invention rather than a limitation of the results that may be achieved.

Having now described the features of a grooved subcarrier relative to a non-grooved or planar subcarrier, we now turn our attention to a grooved subcarrier having a plurality of grooves. a multi-groove subcarrier may be particularly useful in reducing or eliminating both edge non-uniformities and so called "donut-shaped" or annular polishing effects. Annular polishing effects include (i) a first situation when the wafer is over polished at the center and edge and under-polished between the center and edge, or (ii) a second situation when the wafer is under polished at the center and edge but over polished between the center and edge. The multi-groove embodiment will also provide significant uniformity benefits for 300 mm or larger wafer polishing machines.

Figure 27:
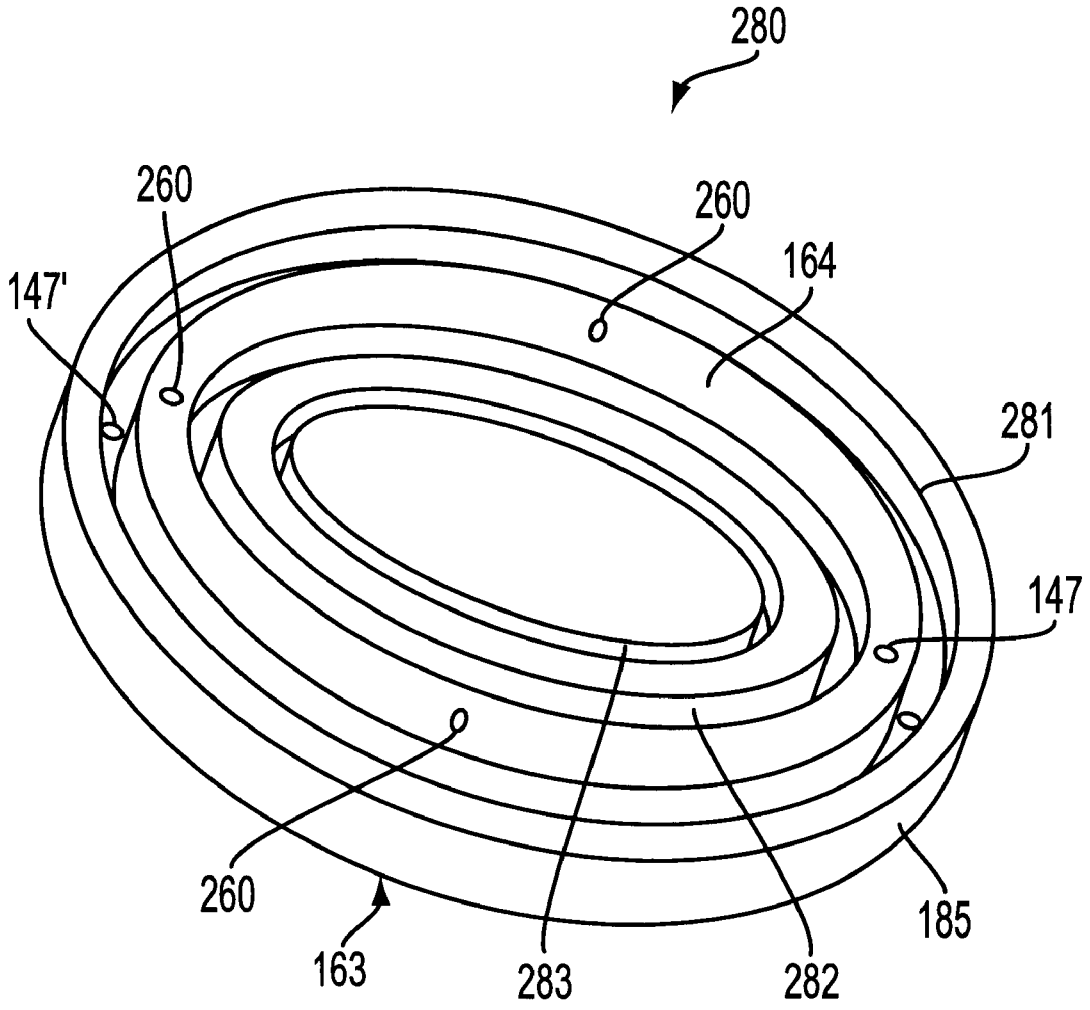
FIG. 27 is a diagrammatic illustration showing the wafer receiving surface of a three-grooved three-pressure chambered embodiment of the inventive wafer subcarrier.

In one embodiment, such as illustrated in FIG. 27, a three groove subcarrier 280 is provided. Three grooves provide additional levels of polishing controls. Subcarriers having two, four, five or more grooves may also be provided and may be particularly useful as the size of the wafer to be polished increases. Each of the grooves 281, 282, 283 being in communication with a separate source of pressurized air and requiring additional rotary union ports of the type already described. The provision of these additional rotary unions and/or rotary union ports are not further described. Each of the three grooves 281, 282, 283 is formed and operates in the same manner as already described, and such description is not repeated here. When space within the subcarrier for channels becomes an issue, some channels may be formed at different depths within the subcarrier, the number of channels per grove may be reduced somewhat, for example from six channels to from 2 to 4 channels, and other channels may be provided using fittings and tubing rather than bores within the subcarrier.

While in a multi-groove multi-chamber embodiment, each of the plurality of grooves may be placed at will to affect the desired polishing pressure profile, it is convenient to discuss polishing zones in the context of at least one embodiment of the invention. In one embodiment of the three-groove subcarrier 280, the first groove 281 is desirably located in a first annular zone located at a distance of from about 0.10 inches to about 1.2 inches from the edge of the subcarrier to overcome any edge over polishing or edge under polishing. The second groove 282 is located in a second zone located at from about 1.2 inches (the inner radius of the first zone) to about 2.7 inches to assist in correcting for an annular-shaped polishing process wherein there is either over (or under) polishing at the center and edge, but under polishing (or over polishing) in-between the center and edge. Finally, the third groove 283 is located in a third zone located between about 2.7 inches of the edge of the wafer (the inner radial boundary of the second zone) and the center of the subcarrier to overcome any over polishing (or under polishing) of the wafer in the central region. While annular grooves are preferred because of their symmetry and the more uniform polishing pressure they are likely to provide, an analogous polishing profile may alternatively be effectuated with a plurality of separate radial arcs, circular patches, or other distributions of pressure on the surface of the subcarrier. Furthermore, annular grooves may be combined with other non annular pressure patches. Within each of these zones the groove itself may be located anywhere within the zone and sized as already described.

In a further embodiment of the invention, the amount of material removed or remaining may be monitored during the polishing process, and the pressure to one or more of the chambers modified accordingly to accomplish uniform polishing. This end-point detection may utilize electronic, magnetic, or optical detection means and would be coupled to a computer control system for modulating the pressure to the subcarrier, retaining ring, and/or one or more grooves that may be present.

Normally, although these ranges abut, a separation of at least about one-tenth of an inch should be provided between the different grooves. Pressure in each of the grooves may generally be positive pressure (0 to 15 psi typically), or a vacuum. Frequently, the precise locations of the grooves and the pressure or vacuum applied to the groove will be adjusted based on the characteristics of the process so that exact locations and pressures even if provided would generally not suit each application.

The inventive single-grooved and multi-grooved subcarrier may be used in conjunction with the floating head and floating retaining ring, but may also be adapted to other substrate polishing and planarization machines and applications, including those that do not utilize the wafer subcarrier assembly 106 or head mounting assembly already described in detail. The inventive grooved subcarrier may readily be applied to any polishing head application wherein it is desired to modify the polishing profile of the wafer as a function of radial location.

Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims. All publications and patent applications cited in this specification are herein incorporated by reference as if each individual publication or patent application were specifically and individually indicated to be incorporated by reference.

What is claimed is:

1. A disc-shaped semiconductor wafer carrier for mounting a semiconductor wafer substrate to be polished or planarized in a semiconductor wafer processing apparatus, said semiconductor wafer carrier comprising:

a disk-shaped block of substantially non-porous material having a first surface for mounting said semiconductor wafer, a second surface, and a third substantially cylindrical surface connecting said first and second surfaces;

said first surface being substantially planar except for a plurality of concentric annular non-planar cavities extending from said substantially planar surface into an interior portion of said wafer carrier;

a fluid communication channel extending from each said cavity to communicate pressurized fluids from external sources of pressurized fluid to said cavities;

said first surface adapted to receive a flexible membrane to cover said cavities and form a plurality of concentric pressure chambers each capable of holding a pressure when said pressurized fluids are communicated from said external sources of pressurized fluids to said cavities; and said membrane expanding locally proximate said non-planar cavities when said pressurized fluids are communicated to said chambers and exerting forces on a semiconductor wafer mounted to said membrane.

2. A polishing apparatus comprising:

a housing;

a disc shaped carrier having a mounting surface for mounting a backside surface of a substrate to be polished;

a retaining ring substantially circumscribing said carrier for retaining said substrate in a pocket formed by said retaining ring and a surface of said carrier;

a first flexible coupling attaching said retaining ring to said carrier such that said retaining ring may translate in at least one dimension and tilt about an axis relative to said carrier;

a second flexible coupling attaching said carrier to said housing such that said carrier may translate in at least one dimension and tilt about an axis relative to said housing;

said housing and said first flexible coupling defining a first chamber in fluid communication with a first source of pressurized gas such that when gas at a first pressure is communicated to said first chamber a first force is exerted against said retaining ring; and said housing and said second flexible coupling defining a second chamber in fluid communication with a second source of pressurized gas such that when gas at a second pressure is communicated to said second chamber a second force is exerted against said carrier;

said carrier mounting surface defining a groove proximate a peripheral edge of said carrier and covered by a substantially non-porous thin flexible sheet of material;

said material covered groove forming a third chamber in fluid communication with a third source of pressurized gas such that when gas at a third pressure is communicated to said third chamber a third force is exerted against said material and through said material to said substrate backside surface proximate said groove to thereby modify a polishing pressure proximate the peripheral edge of said substrate.

3. The polishing apparatus in claim 2, wherein said translation and tilt of said carrier is independent of said translation and tilt of said retaining ring.

4. The polishing apparatus in claim 2, wherein said translation and tilt of said carrier is coupled to a predetermined extent with said translation and tilt of said retaining ring.

5. The polishing apparatus in claim 2, wherein said translation and tilt of said carrier and said translation and tilt of said retaining ring each have a component that is independent of the other and a component that is dependent on the other.

6. The polishing apparatus in claim 5, wherein the extent to which said translation and tilt components of said carrier and said ring are coupled is dependent on material characteristics of said first and second flexible couplings and geometry characteristics of said first flexible coupling attaching said retaining ring to said carrier and said second flexible coupling attaching said carrier to said housing.

7. The polishing apparatus in claim 6, wherein said material characteristics that affect the extent of coupling include elasticity, stiffness, and spring constant; and said geometry characteristics include distance between attachment locations between said ring and said carrier and distance between attachment locations between said carrier and said housing; the geometry of an interface between said first and second flexible couplings and adjacent structures of said housing, said retaining ring, and said carrier.

8. The polishing apparatus in claim 2, wherein said first pressure, said second pressure, and said third pressure are different pressures.

9. The polishing apparatus in claim 2, wherein said first pressure and said second pressure are substantially equal pressures.

10. The polishing apparatus in claim 2, wherein said first pressure and said second pressure are substantially equal pressures and the force exerted on said retaining ring and on said carrier are determined by the surface area of said retaining ring and said carrier over which each said pressure is applied, and wherein said third pressure either greater than or less than said second pressure.

11. The polishing apparatus in claim 2, wherein said first pressure, said second pressure, and said third pressure may independently be positive pressure or negative pressure.

12. The polishing apparatus in claim 11, wherein the depth of a pocket formed by a surface of said carrier and an inner cylindrical surface of said retaining ring is established during a substrate loading phase by said first pressure and said second pressure.

13. The polishing apparatus in claim 2, wherein said substrate comprises a semiconductor wafer.

14. The polishing apparatus in claim 2, wherein said retaining ring further comprises:

a lower surface for contacting an external polishing pad during polishing;

an inner cylindrical surface disposed adjacent to an outer circumferential surface of said carrier at a periphery of said substrate mounting surface of said carrier, said inner cylindrical surface and said carrier mounting surface forming a pocket for maintaining said substrate during polishing; and a pad conditioning member disposed at a lower outer radial portion of said retaining ring where said retaining ring contacts said pad during polishing and defining a shape profile transitioning between a first planar surface substantially parallel to a plane of said polishing pad and a second planar surface substantially perpendicular to said polishing pad.

15. The polishing apparatus in claim 2, wherein said first pressure on said carrier is in the range between substantially 1.5 psi and substantially 10 psi and the second pressure on said retaining ring is in the range between substantially 1.5 psi and substantially 9.0 psi.

16. The polishing apparatus in claim 2, wherein said flexible coupling comprises a diaphragm.

17. The polishing apparatus in claim 2, wherein said diaphragm is formed from a material selected from the group consisting of: metal, plastic, rubber, polymer, titanium, stainless-steel, carbon fibre composite, and combinations thereof.

18. The polishing apparatus in claim 2, wherein said carrier is formed from ceramic material.

19. A polishing apparatus comprising:

a housing;

a disc shaped carrier having a mounting surface for mounting a backside surface of a semiconductor wafer substrate to be polished;

a retaining ring substantially circumscribing said carrier for retaining said substrate in a pocket formed by said retaining ring and a surface of said carrier;

a first flexible coupling attaching said retaining ring to said carrier such that said retaining ring may translate in at least one dimension and tilt about an axis relative to said carrier; and a second flexible coupling attaching said carrier to said housing such that said carrier may translate in at least one dimension and tilt about an axis relative to said housing;

said housing and said first flexible coupling defining a first chamber in fluid communication with a first source of pressurized gas such that when gas at a first pressure is communicated to said first chamber a first force is exerted against said retaining ring;

said housing and said second flexible coupling defining a second chamber in fluid communication with a second source of pressurized gas such that when gas at a second pressure is communicated to said second chamber a second force is exerted against said carrier;

said disc shaped carrier further comprises:

at least one cavity formed into said wafer substrate mounting surface of said carrier;

a fluid communication channel extending from said at least one cavity to an external source of pressurize fluid;

said wafer mounting surface adapted to receive a flexible membrane, said membrane covering said at least one cavity to form a third chamber capable of holding a pressure when said pressurized fluid is communicated from said external source of pressurized fluid to said at least one cavity; and said membrane expanding when said pressurized fluid is communicated to said third chamber and exerting a force on a wafer mounted between said membrane and an external polishing pad during polishing.

20. A polishing apparatus comprising:

a housing;

a disc shaped carrier for mounting a substrate to be polished;

a retaining ring substantially circumscribing said carrier for retaining said substrate in a pocket formed by said retaining ring and a surface of said carrier;

a first flexible coupling attaching said retaining ring to said carrier such that said retaining ring may translate in at least one dimension and tilt about an axis relative to said carrier; and a second flexible coupling attaching said carrier to said housing such that said carrier may translate in at least one dimension and tilt about an axis relative to said housing;

said housing and said first flexible coupling defining a first chamber in fluid communication with a first source of pressurized gas such that when gas at a first pressure is communicated to said first chamber a first force is exerted against said retaining ring;

said housing and said second flexible coupling defining a second chamber in fluid communication with a second source of pressurized gas such that when gas at a second pressure is communicated to said second chamber a second force is exerted against said subcarrier;

said disk-shaped carrier comprises:

a disk-shaped block of substantially non-porous material having a first surface for mounting said substrate, a second surface, and a third substantially cylindrical surface connecting said first and second surfaces;

said first surface being substantially planar except for a non-planar cavity extending from said substantially planar surface into an interior portion of said substrate carrier;

a fluid communication channel extending from said cavity to either said second surface or to said third surface to communicate a pressurized fluid from an external source of pressurized fluid to said cavity;

said first surface adapted to receive a flexible membrane to cover said cavity and form a chamber capable of holding a pressure when said pressurized fluid is communicated from said external source of pressurized fluid to said cavity; and said membrane expanding when said pressurized fluid is communicated to said third chamber and exerting a force on a substrate mounted to said membrane.

21. The polishing apparatus in claim 20, wherein said non-planar cavity comprises an annular groove having at least two substantially cylindrical parallel sidewalls and a substantially flat bottom wall extending between said sidewalls.

22. The polishing apparatus in claim 20, wherein said non-planar cavity comprises an annular V-shaped groove.

23. The polishing apparatus in claim 20, wherein said non-planar cavity comprises an annular C-shaped groove.

24. The polishing apparatus in claim 20, wherein:

said first surface further including a plurality of said non-planar cavities extending from said substantially planar surface into an interior portion of said wafer carrier;

a fluid communication channel extending from said plurality of said cavities to communicate a pressurized fluid from an external source of pressurized fluid to said cavity;

each said cavity being covered by said flexible membrane to form a plurality of chambers capable of holding pressure when said pressurized fluids are communicated from said external sources of pressurized fluid to said cavities; and said flexible membrane expanding when said pressurized fluid is communicated to said third chamber and exerting a force on a wafer mounted to said membrane.

25. The polishing apparatus in claim 20, wherein said non-planar cavity comprises an annular groove having at least two substantially cylindrical parallel sidewalls and a substantially flat bottom wall extending between said sidewalls.

26. A semiconductor wafer processing apparatus comprising:

a housing;

a disc shaped carrier for mounting a semiconductor wafer substrate to be polished or planarized;

a retaining ring substantially circumscribing said carrier for retaining said substrate in a pocket formed by said retaining ring and a surface of said carrier;

a first flexible coupling attaching said retaining ring to said carrier such that said retaining ring may translate in at least one dimension and tilt about an axis relative to said carrier; and a second flexible coupling attaching said carrier to said housing such that said carrier may translate in at least one dimension and tilt about an axis relative to said housing;

said housing and said first flexible coupling defining a first chamber in fluid communication with a first source of pressurized gas such that when gas at a first pressure is communicated to said first chamber a first force is exerted against said retaining ring;

said housing and said second flexible coupling defining a second chamber in fluid communication with a second source of pressurized gas such that when gas at a second pressure is communicated to said second chamber a second force is exerted against said subcarrier; and said disk-shaped carrier comprises:

a disk-shaped block of substantially non-porous material having a first surface for mounting said semiconductor wafer, a second surface, and a third substantially cylindrical surface connecting said first and second surfaces;

said first surface being substantially planar except for a plurality of concentric annular non-planar cavities extending from said substantially planar surface into an interior portion of said wafer carrier;

a fluid communication channel extending from each said cavity to communicate pressurized fluids from external sources of pressurized fluid to said cavities;

said first surface adapted to receive a flexible membrane to cover said cavities and form a plurality of concentric pressure chambers each capable of holding a pressure when said pressurized fluids are communicated from said external sources of pressurized fluids to said cavites; and said membrane expanding locally proximate said non-planar cavities when said pressurized fluids are communicated to said chambers and exerting forces on a semiconductor wafer mounted to said membrane.

27. The polishing apparatus in claim 26, wherein said non-planar cavity comprises an annular V-shaped groove.

28. The polishing apparatus in claim 26, wherein said non-planar cavity comprises an annular C-shaped groove.

* * * * *